US007992856B2

(12) United States Patent
Saito

(10) Patent No.: US 7,992,856 B2
(45) Date of Patent: Aug. 9, 2011

(54) GRIPPER DISCHARGE FOR SHEET PROCESSING APPARATUS

(75) Inventor: Takashi Saito, Higashiyatsushiro-gun (JP)

(73) Assignee: Nisca Corporation, Yamanashi (JP)

( * ) Notice: Subject to any disclaimer, the term of this patent is extended or adjusted under 35 U.S.C. 154(b) by 128 days.

(21) Appl. No.: 12/385,643

(22) Filed: Apr. 15, 2009

(65) Prior Publication Data

US 2009/0261522 A1 Oct. 22, 2009

(30) Foreign Application Priority Data

Apr. 22, 2008 (JP) ..... 2008-111409

(51) Int. Cl.
*B65H 37/04* (2006.01)

(52) U.S. Cl. ..... 270/58.11; 270/58.08; 270/58.12

(58) Field of Classification Search ..... 270/58.08, 270/58.11, 58.12, 58.13
See application file for complete search history.

(56) References Cited

U.S. PATENT DOCUMENTS

| | | | | |
|---|---|---|---|---|
| 5,447,298 | A * | 9/1995 | Watanabe et al. | 270/58.11 |
| 5,580,038 | A * | 12/1996 | Furuya et al. | 270/58.11 |
| 5,580,039 | A * | 12/1996 | Takehara et al. | 270/58.11 |
| 5,951,000 | A * | 9/1999 | Sato et al. | 270/58.11 |
| 5,997,239 | A * | 12/1999 | Mimura et al. | 414/789.9 |
| 7,487,959 | B2 * | 2/2009 | Noh | 270/58.12 |
| 7,731,169 | B2 * | 6/2010 | Saito | 270/58.12 |
| 2003/0025888 | A1 * | 2/2003 | Noh | 355/18 |

FOREIGN PATENT DOCUMENTS

JP 2006-256729 9/2006

* cited by examiner

*Primary Examiner* — Patrick Mackey
(74) *Attorney, Agent, or Firm* — Manabu Kanesaka

(57) ABSTRACT

A sheet processing apparatus is provided with a sheet discharge path (first carry-in path P1) that sequentially carries out a sheet, a processing tray that collects sheets from the sheet discharge path in the shape of a bunch, a stacker that holds the sheets from the processing tray, and bunch carrying device disposed in the processing tray to carry out a bunch of sheets toward the stacker. The bunch carrying-out device includes a carrier member disposed movably in the sheet-bunch carrying-out direction of the processing tray, and a sheet engagement member that engages the bunch of sheets on the processing tray. The sheet engagement member is mounted on the carrier member to be able to move to position in the sheet-bunch carrying-out direction.

10 Claims, 16 Drawing Sheets

GRIPPER DISCHARGE FOR SHEET PROCESSING APPARATUS

BACKGROUND OF THE INVENTION

1. Technical Field

The present invention relates to a sheet processing apparatus for collecting sheets carried out from an image formation apparatus, etc. in the shape of a bunch for each set to perform processing such as binding and the like, and more particularly, to improvements in a sheet-bunch carrying-out mechanism that carries out a processed sheet bunch to a stack tray on the downstream side.

2. Description of the Related Art

Generally, this type of sheet processing apparatus is known as an apparatus for collecting sheets carried out from an image formation apparatus, etc. for each set, performing post-processing such as binding, punching processing, stamping processing and the like on the sheets, and storing the processed sheet bunch on a stack tray. Therefore, a processing tray is disposed on the downstream side of the sheet discharge path, the stack tray is disposed on the further downstream side, and sheets that are sequentially carried out to the processing tray are collected for each set and undergo post-processing in a stapling unit and the like. Then, the processed sheet bunch is stored on the stack tray coupled to a sheet discharge outlet of the processing tray.

For example, in Japanese Pat. Publication 2006-256729, a level difference is formed on the downstream side of the sheet discharge path to provide a processing tray, and in the processing tray are disposed a regulating stopper against which the sheet end is pushed to regulate, and a stapling apparatus for performing binding processing. Then, sheets carried out from the sheet discharge path are collected for each set in the processing tray, and the sheets are positioned by the regulating stopper, and bound by the stapling apparatus. Therefore, a bunch carrying-out mechanism is required which carries out a processed sheet bunch from the processing tray to the stack tray on the downstream side.

In the bunch carrying-out mechanism of above-mentioned Japanese Pat. Publication 2006-256729 is installed with a carrier member such as an endless belt or the like traveling along from one end to the other end of the sheet support surface of the processing tray, and the carrier member is provided with a sheet engagement member (sheet engagement pawl) to engage with the sheet rear end on the tray. Then, such a structure is adopted that the carrier member travels along the tray, and that the sheet rear end is thereby pushed out by the sheet engagement pawl to be carried out.

The sheet engagement pawl is not disclosed in Japanese Pat. Publication 2006-256729, but a pair of right and left sheet engagement pawls are disposed spaced apart from each other in the sheet width direction of the processing tray, and configured to push out a sheet bunch along the tray. Then, the sheet engagement pawls wait in a standby position (home position) spaced on the back side of the processing tray, and go forward in the sheet carrying-out direction from the standby position to engage with the sheet rear end edge after sheets are collected on the processing tray and undergo the post-processing. Then, it is configured that this bunch of sheets are carried out to the stack tray on the downstream side along the sheet support surface of the processing tray.

As described above, when a bunch of sheets collected on the tray are carried out to the stack tray on the downstream side, the carrying-out mechanism has conventionally been adopted that the sheet engagement pawls are moved from one end to the other end of the tray by an endless belt or the like.

In this case, it is configured that the carrier member such as an endless belt, etc. and the sheet engagement pawls are integrally coupled, and that the sheet engagement pawls are moved to positions in the sheet carrying-out direction by travel of the belt. Then, the sheet engagement pawls turn or reciprocate along the sheet support surface of the processing tray.

In such a conventional bunch carrying-out mechanism, the carrier member such as an endless belt or the like and the sheet engagement pawls are integrally coupled. Then, the sheet engagement members are configured to wait to engage with the rear end edge of a bunch of sheets on the back side in the base end portion of the processing tray, while in the front end portion of the processing tray, delivering the sheets in a position protruding to the stack tray on the downstream side. Accordingly, there is the defect that the traveling stroke increases in the sheet engagement members, and that the apparatus thereby increases in size.

Further, the conventional sheet engagement pawls are formed of projection pawls that engage with the rear end edge of a bunch of sheets, thereby kick downward the bunch of sheets to the stack tray from the processing tray in delivering the bunch of sheets to the stack tray on the downstream side, do not enable bunches of sheets to be stacked and stored neatly on the stack tray, and are known as having the defect that the bunches are stored without being neatly aligned.

Therefore, it is desired that a bunch of sheets on the processing tray are gripped, pushed to be carried out, and landed without a level difference when the bunch of sheets are delivered to the stack tray. By this means, it is possible to prevent occurrence of problems such as creases, buckling and the like in moving a bunch of sheets along the processing tray, and concurrently, store bunches neatly on the stack tray.

The inventor of the present invention contrived the mechanism for gripping the rear end edge of a bunch of sheets to carry out in carrying out the bunch of sheets on the processing tray to the stack tray on the downstream side (for example, the Patent Application). Then, the inventor encountered the problem that the apparatus is increased in size when the grip mechanism is mounted on the carrier member such as a belt or the like.

Therefore, the inventor reached the idea that a sheet engagement member such as a grip mechanism or the like is installed in a carrier member such as a belt or the like to be able to move to positions in the bunch carrying-out direction, and that the sheet engagement member is stored in an attitude overlapping with the carrier member in an initial position for engaging with a bunch of sheets on the tray, and moves to a position protruding forward from the carrier member in a carrying-out position for carrying out the bunch of sheets to the stack tray.

It is an object of the invention to provide a sheet processing apparatus enabling a bunch of sheets to be neatly stored on a stack tray without a crease, buckling and the like occurring in the bunch of sheets in carrying out the bunch of sheets on a processing tray to the stack tray on the downstream side. Further, it is another object of the invention to provide a sheet processing apparatus enabling a small compact configuration of a bunch carrying-out mechanism for carrying out a bunch of sheets.

BRIEF SUMMARY OF THE INVENTION

To attain the above-mentioned objects, the present invention adopts the following constitution. Provided are a sheet discharge path (first carry-in path P1 described later) that sequentially carries out a sheet, a processing tray (29) that collects sheets from the sheet discharge path in the shape of a bunch, a stacker (stack tray 21 described later) that is disposed on the downstream side of the processing tray and that holds the sheets from the processing tray, and bunch carrying-out means (100) disposed in the processing tray to carry out a bunch of sheets toward the stacker, the bunch carrying-out means is comprised of a carrier member (110) disposed movably in the sheet-bunch carrying-out direction of the processing tray, and a sheet engagement member (105) that engages with the bunch of sheets on the processing tray, and the sheet engagement member is mounted on the carrier member to be able to move to positions in the sheet-bunch carrying-out direction.

The carrier member (110) is provided with a carrier driving means (114) for moving the carrier member to positions in the sheet-bunch carrying-out direction along the processing tray (29), and the sheet engagement member (105) is provided with an engagement member driving means (127) for moving the sheet engagement member to positions in the sheet-bunch carrying-out direction along the carrier member (110).

A control means (167) controlling the carrier driving means (114) and the engagement member driving means (127) controls the carrier driving means to move the carrier member to the front end from the base end of the processing tray, while controlling the engagement member driving means to travel between a base-end storing position overlapping with the carrier member and a front-end carrying-out position protruding from the carrier member in the sheet-bunch carrying-out direction.

The control means has a first operation control mode for causing the carrier member to reciprocate between the base end and the front end of the processing tray with the engagement member being in the base-end storing position, a second operation control mode for moving the sheet engagement member to the front-end carrying-out position protruding in the sheet-bunch carrying-out direction from the base-end storing position with the carrier member resting in a predetermined position (for example, the base end position) of the processing tray, and a third operation control mode for moving the carrier member to the front end from the base end of the processing tray, and further, moving the engagement member to the front-end carrying-out position protruding in the sheet-bunch carrying-out direction, and executes the initial operation in the first operation control mode and/or the second operation control mode in starting the apparatus.

The sheet engagement member is comprised of a gripper member for grasping a bunch of sheets collected on the processing tray, and the gripper member has a grip releasing means.

The carrier member driving means and the engagement member driving means are configured to enable the carrier member and the sheet engagement member to move in mutually opposite directions in carrying out the bunch of sheets on the processing tray, and when the sheet engagement member engages with the bunch of sheets on the processing tray and/or releases the sheets to the stack tray, move the sheet engagement member in the direction opposite to the movement direction of the carrier member so that the sheet engagement member rests or reduces the speed.

An image formation system according to the invention is comprised of an image formation apparatus that sequentially forms an image on a sheet, and a sheet processing apparatus that performs post-processing on the sheet from the image formation apparatus, where the sheet processing apparatus has the above-mentioned configuration.

EFFECTS OF THE INVENTION

The present invention is to control the positions of the sheet engagement member that engages with a bunch of sheets and of the carrier member that moves the sheet engagement member to positions from one end to the other end along the tray in carrying out the bunch of sheets on the processing tray to the stack tray on the downstream side where the sheet engagement member is mounted on the carrier member to be able to move to positions in the sheet-bunch carrying-out direction, so that the sheet engagement member overlaps with the carrier member in the base end position, and protrudes from the carrier member toward the stack tray in the front-end carrying-out position, and has the following effects.

The sheet engagement member engaging with the end edge of a bunch of sheets is subjected to positional control to be a storage attitude overlapping with the carrier member in the base-end storing position, and to be a carrying-out attitude protruding from the carrier member in the sheet-bunch carrying-out direction in the front-end carrying-out position, when being moved from one end to the other end of the processing tray by the carrier member. Therefore, the entire bunch carrying-out mechanism is short in traveling stroke, and it is possible to configure a small compact apparatus.

Further, the sheet engagement member is mounted on the carrier member to be able to move to positions in the sheet-bunch carrying-out direction, and thus, can be controlled to a moving speed optimal to engagement (including grip) with a bunch of sheets, for example, when the carrier member travels in the carrying-out direction at a predetermined speed. Therefore, it is possible to cause the sheet engagement member to rest relatively to the carrier member traveling at a predetermined speed, and to reliably execute the engagement operation and engagement releasing operation of the bunch of sheets.

In other words, when the sheet engagement member is formed of a gripper member for gripping a bunch of sheets to carry out, it is also possible to rest the gripper member with respect to the carrier member traveling at a predetermined speed when the gripper member grips the bunch of sheets at the base end portion of the processing tray, and the gripper member can grasp the bunch of sheets with reliability and safety. Similarly, also when a bunch of sheets are delivered to the stack tray, by resting the gripper member or reducing the speed of the gripper member, it is possible to reliably carry out the bunch of sheets. Accordingly, the bunch of sheets undergo neither damage in the process of carrying out the bunch, nor disarray in the stored attitude when the bunch is stored in the stack tray.

Further, the invention provides the first operation control mode in which the carrier member reciprocates between the base end and front end of the processing tray with the sheet engagement member being in the base-end storing attitude, and the second operation control mode in which the sheet engagement member moves to the front-end carrying-out position protruding in the sheet-bunch carrying-out direction after the carrier member moves to the front end from the base end of the processing tray, and therefore, enables the initial state to be set promptly with the first operation control mode in initializing the apparatus, while enabling a bunch of sheets to be carried out with the second operation control mode in carrying out the sheets.

BRIEF DESCRIPTION OF THE DRAWINGS

FIG. 8*a* is an explanatory view of a state where a bunch of sheets are nipped, FIG. 8*b* is an explanatory view of a state where the bunch of sheets are released from the nip, and FIG. 9*c* is an explanatory view of a state where the bunch of sheets are carried out to the stack tray;

FIG. 10*a* shows a first standby position state, and FIG. 10*c* shows an initial state to back to a second standby position;

FIG. 11*e* shows a second standby position state, FIG. 11*f* shows a state where the bunch of sheets are nipped, and FIG. 11*g* shows a state where the bunch of sheets are carried out;

FIG. 12*h* shows a state where a bunch of sheets are moved to above a stack tray, FIG. 12*i* shows a state where the bunch of sheets are carried out onto the stack tray, FIG. 12*j* shows a state immediately after the bunch of sheets are stacked on the stack tray, and FIG. 12*k* is a state where the means returns to the first standby position;

FIG. 14*a* shows a state where a sheet is stored in the stack tray from a sheet discharge path, FIG. 14*b* shows a state where sheets are collected as a set on the processing tray from the sheet discharge path, and FIG. 14*c* shows a state where a bunch of sheets are carried out onto the stack tray from the processing tray;

FIG. 15*a* shows the entire configuration, and FIG. 15*b* shows a traveling mechanism in the sheet width direction.

DETAILED DESCRIPTION OF THE INVENTION

Figure 1:
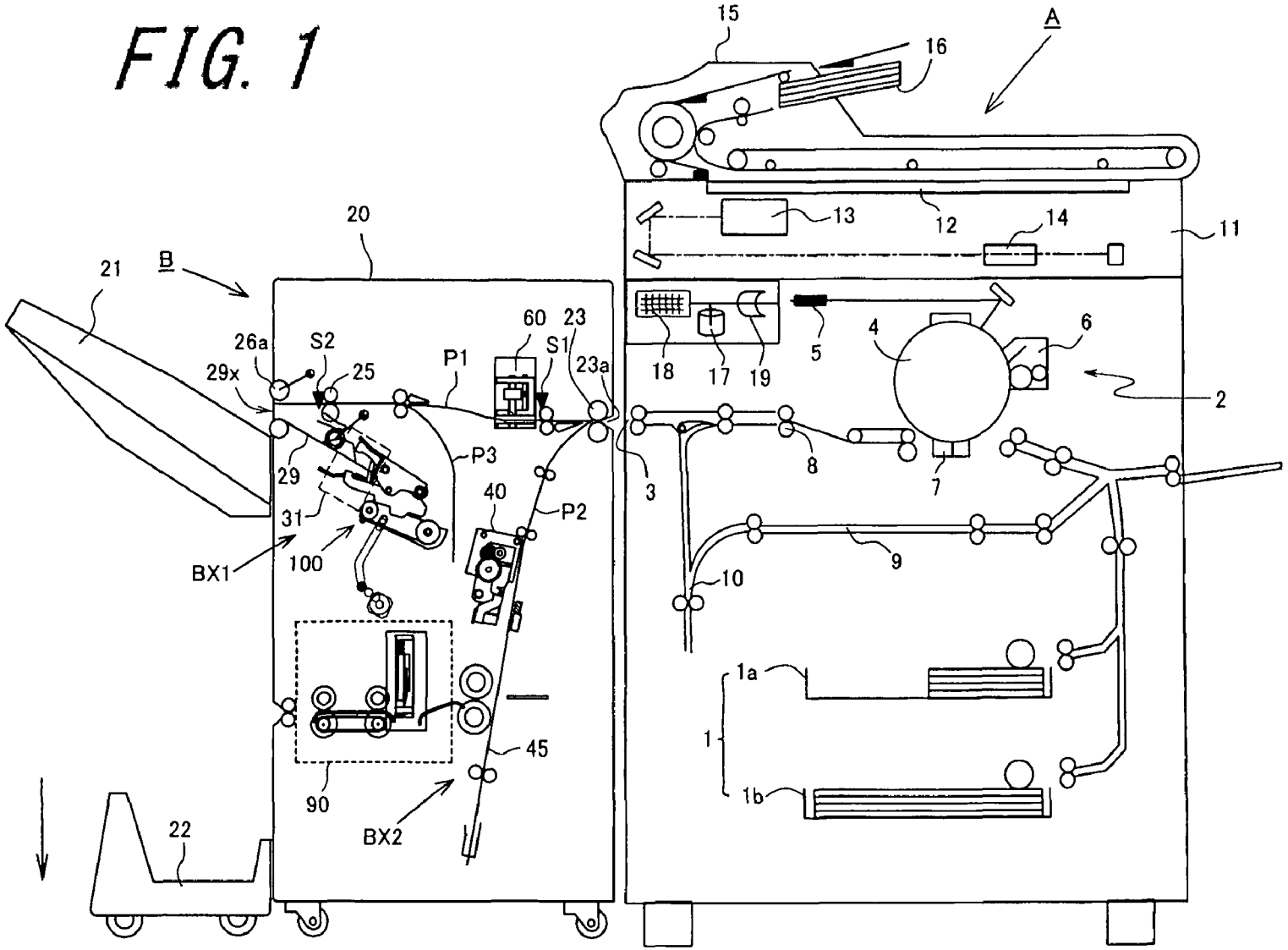
FIG. 1 is an entire configuration view of an image formation system according to the invention.
Figure 2:
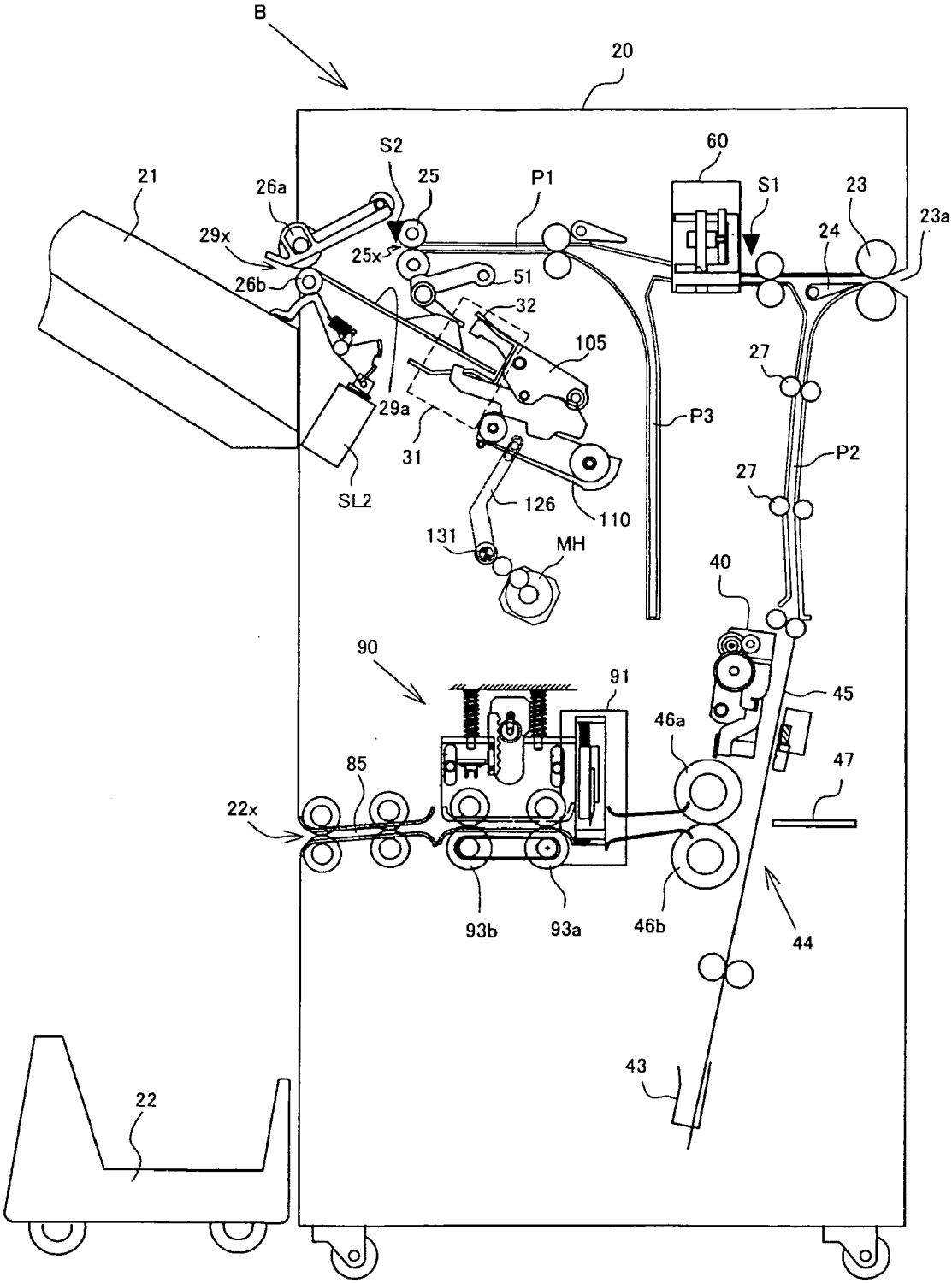
FIG. 2 is an entire configuration view of a post-processing apparatus (sheet handling apparatus) in the system of FIG. 1.
Figure 3:
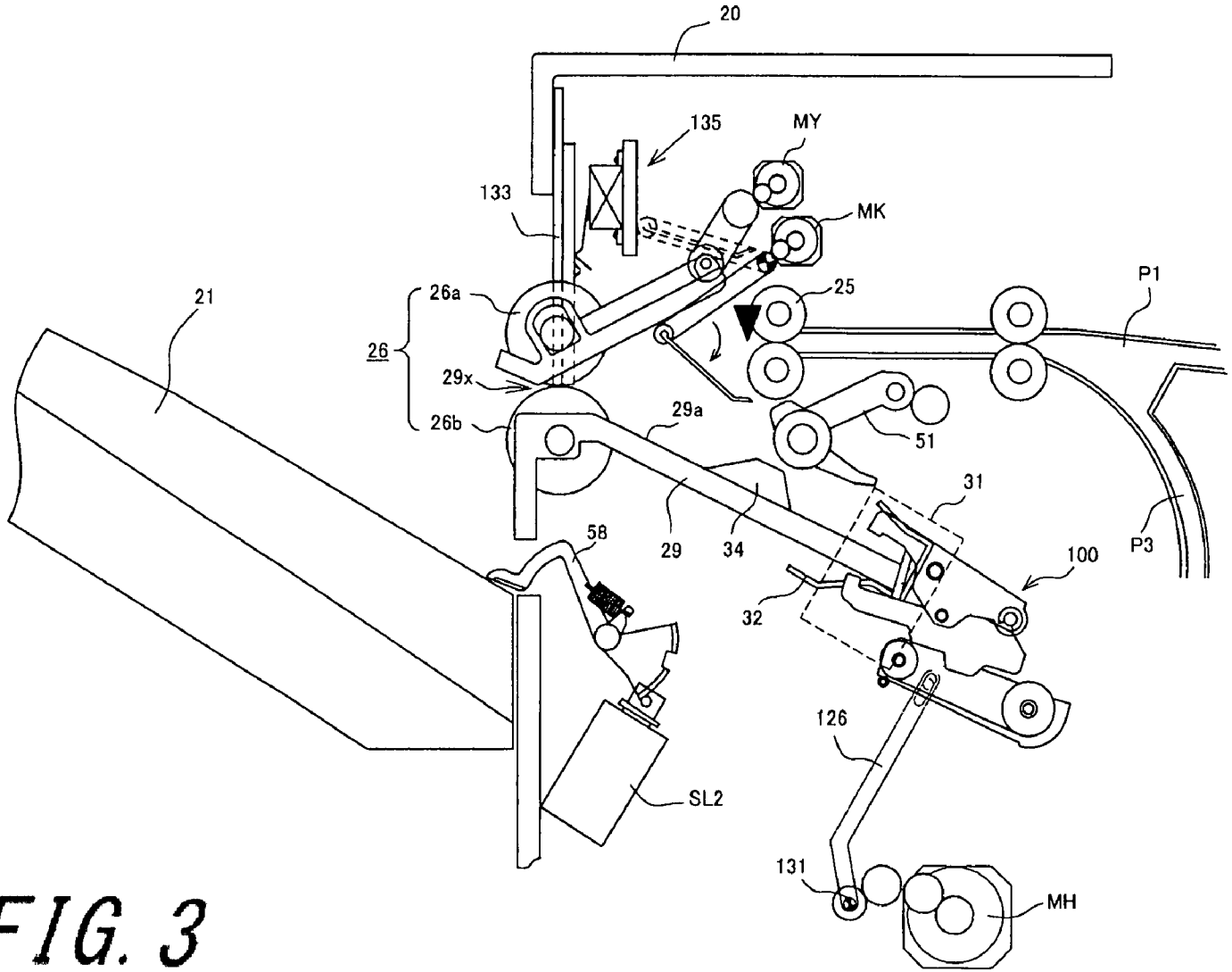
FIG. 3 is an explanatory view of main parts of the post-processing apparatus of FIG. 2.

The present invention will specifically be described below based on preferred embodiments of the invention as shown in accompanying drawings. FIG. 1 is an entire configuration view showing an image formation system provided with an image formation apparatus A and a post-processing apparatus B according to the invention, FIG. 2 is an explanatory view of a detailed configuration of the post-processing apparatus B, and FIG. 3 is an explanatory view of main parts of the apparatus B.

[Configuration of the Image Formation System]

The image formation system as shown in FIG. 1 is formed of the image formation apparatus A and the post-processing apparatus (sheet processing apparatus; which is the same in the following description) B. Then, a carry-in entrance 23*a* of the post-processing apparatus B is coupled to a sheet discharge outlet 3 of the image formation apparatus A, and it is configured that sheets with images formed thereon in the image formation apparatus A are stapled in the post-processing apparatus B and stored in a stack tray 21 and saddle tray 22.

[Configuration of the Image Formation Apparatus]

The image formation apparatus A will be described according to FIG. 1. The image formation apparatus A is configured so that a sheet is fed to an image formation section 2 from a sheet feeding section 1, printed in the image formation section 2, and discharged from the sheet discharge outlet 3. In the paper feeding section 1, sheets with different sizes are stored in paper cassettes 1*a* and 1*b*, and designated sheets are separated on a sheet basis and fed to the image formation section 2. In the image formation section 2 are arranged, for example, an electrostatic drum 4, and a print head (laser emitter) 5, developer 6, transfer charger 7 and fuser 8 disposed around the drum, an electrostatic latent image is formed on the electrostatic drum 4 with the laser emitter 5, the developer 6 adds toner to the image, and the image is transferred onto the sheet with the transfer charger 7, and heated and fused with the fuser 8. The sheet with the image thus formed is sequentially carried out from the sheet discharge outlet 3. "9" shown in the figure denotes a circulating path, and is a path for two-side printing for revising the side of the sheet with printing on its front side from the fuser 8 via a switch-back path. 10, and feeding the sheet again to the image formation section 2 so as to print on the back side of the sheet. The side of the two-side printed sheet is reversed in the switch-back path 10, and the sheet is carried out from the sheet discharge outlet 3.

"11" shown in the figure denotes an image scanning apparatus, where an original sheet set on a platen 12 is scanned with a scan unit 13, and electrically read with a photoelectric conversion element not shown. The image data is subjected to, for example, digital processing in an image processing section, and then transferred to a data storing section 14, and an image signal is sent to the laser emitter 5. Further, "15" shown in the figure is an original feeding apparatus, and is a feeder apparatus for feeding an original sheet stored in a stack tray 16 to the platen 12.

Figure 16:
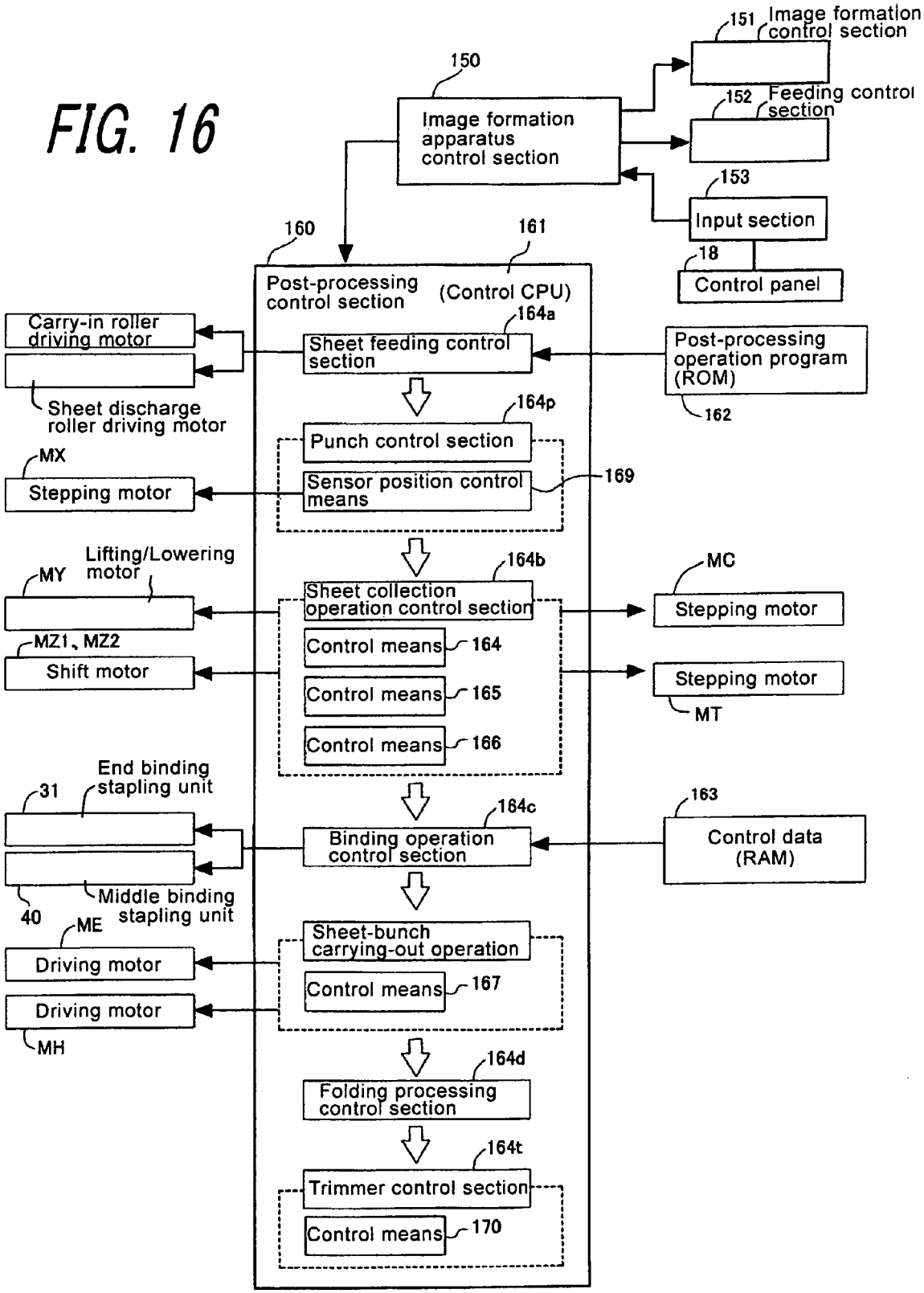
FIG. 16 is a block diagram of a control configuration in the image formation system of FIG. 1.

The image formation apparatus A with the above-mentioned configuration is provided with a control section (controller) 150 as shown in FIG. 16, and from a control panel 18 are set image printing conditions such as, for example, sheet size designation, color/monochrome printing designation, number-of-printed sheet designation, one-side/two-side printing designation, scaling printing designation and the like. Meanwhile, it is configured in the image formation apparatus A that image data read by the scan unit 13 or image data transferred from an external network is stored in a data storing section 17, the image data is transferred to a buffer memory 19 from the data storing section 17, and that a data signal is sequentially output to the laser emitter 5 from the buffer memory 17.

A post-processing condition is also input and designated from the control panel 18, concurrently with the image formation conditions such as one-side/two-side printing, scaling printing, monochrome/color printing and the like. Selected as the post-processing condition is, for example, a "print-out mode", "binding finish mode", "brochure finish mode" or the like.

[Configuration of the Post-processing Apparatus]

The post-processing apparatus B is configured as described below to receive a sheet with the image formed thereon from the sheet discharge outlet 3 of the image formation apparatus A, and to (i) store the sheet in a stack tray 21 ("print-out mode" as described above), (ii) collect sheets from the sheet discharge outlet 3 in the shape of a bunch for each set to staple, and store in the stack tray (first stack tray) 21 ("binding finish mode" as described above), or (iii) collect sheets from the sheet discharge outlet 3 in the shape of a bunch for each set, staple its center, fold in the shape of a brochure and store in a saddle tray (second stack tray) 22 ("brochure finish mode" as described above).

A casing (exterior cover) 20 of the post-processing apparatus B is provided with the carry-in entrance 23*a*, and the carry-in entrance 23*a* is coupled to the sheet discharge outlet 3 of the image formation apparatus A. In the casing 20 are provided a first processing section BX1 that collects sheets from the carry-in entrance 23*a* for each set to perform a binding finish, and a second processing section BX2 that collects sheets from the carry-in entrance 23*a* for each set to perform a brochure finish. A first carry-in path P1 is provided between the first processing section BX1 and the carry-in entrance 23*a*, and a second carry-in path P2 is provided between the second processing section BX2 and the carry-in entrance 23*a*, so that the sheet from the carry-in entrance 23*a* is distributed and guided to the first processing section BX1 or the second processing section BX2. The carry-in entrance 23*a* is provided with carry-in rollers 23, sheet sensor S1, and a path switching means (flapper member) 24 that distributes the sheet to the first or second carry-in path P1 or P2.

The first carry-in path P1 is provided with a buffer path P3 between a punch unit 60 and a processing tray 29. The buffer path 3 is provided to temporary hold a subsequent sheet sent to the carry-in entrance 23*a* during a period of time post-processing operation such as stapling or the like is performed on a bunch of sheets collected for each set on the processing tray. Therefore, the first carry-in path P1 is provided with the buffer path 3 which is branched in the vertical direction of the casing 20 as shown in FIG. 2 on the upstream side in the path reaching the processing tray 29. Then, the sheet from the first carry-in path P1 is switched back and stays in this path. Accordingly, when the post-processing (end binding processing described later) is performed on a bunch of sheets collected for each set on the processing tray 29, it is made possible that a subsequent sheet sent to the carry-in entrance 23*a* temporary stays, and that the subsequent sheet is moved to the processing tray 29 after the processed sheets on the processing tray 29 are carried out.

The first carry-in path P1 is disposed substantially in the horizontal direction in the upper portion of the apparatus housing formed of the casing 20, the first processing section BX1 is disposed on the downstream side of the first carry-in path P1, and the stack tray 21 is disposed on the downstream side of BX1. The second carry-in path P2 is disposed substantially in the vertical direction in the lower portion of the casing 20, the second processing section BX2 is disposed on the downstream side of the second carry-in path P2, and the saddle tray 22 is disposed on the downstream side of BX2. In addition, in the first carry-in path P1, the punch unit 6 described later is disposed between the carry-in entrance 23*a* and the first processing section BX1. In the second carry-in path P2, a trimmer unit 90 is disposed between the second processing section BX2 and the saddle tray 22.

The first carry-in path P1 is provided at its path outlet end with sheet discharge rollers 25 and a sheet discharge outlet 25*x*. A sheet discharge sensor S2 is disposed in the sheet discharge outlet 25*x*, and is configured to detect a sheet passed through the first carry-in path P1 to detect a jam and count the number of passed sheets. Then, a level difference is formed on the downstream side of the sheet discharge outlet 25*x*, and the processing tray described below is disposed. Further, the second carry-in path P2 is provided with feeding rollers 27, a level difference is formed on the downstream side of the rollers 27, and a collection guide 45 is disposed.

[Configuration of the First Processing Section]

The first processing section BX1 is formed of the processing tray 29 disposed in the first carry-in path P1, an end binding stapling unit 31 disposed in the processing tray 29, and an aligning means 51.

[Configuration of the Processing Tray]

The processing tray 29 is formed of a synthetic resin plate or the like, and is provided with a sheet support surface 29*a* to support sheets loaded therewith. The sheet support surface 29*a* is disposed to form a level difference on the downstream side of the sheet discharge outlet 25*x*, and stores sheets from the sheet discharge outlet 25*x*. The sheet support surface 29*a* as shown in the figure is formed in dimension with a length shorter than the length of the sheet in the discharge direction, and supports the rear end portion of the sheet from the sheet discharge outlet 25*x*, while the sheet front end portion is supported (bridge-supported) on the uppermost sheet on the stack tray 21.

The processing tray 29 is provided with a sheet end regulating means 32, against which the rear end (or front end) of the sheet from the sheet discharge outlet 25*x* is pushed to be aligned. Then, above the processing tray 29 are disposed switch back rollers (first friction rotational member, which is the same in the following) 26 (movable roller 26*a*, fixed roller 26*b*) for feeding a sheet carried onto the tray to the sheet end regulating means 32, aligning means 51, and side aligning means 34. Each structure will be described below.

[Corner Stapling Mode]

Further, a control CPU 161 is configured to offset sheets by shifting the left and right aligning plates 34L, 34R by a predetermined amount in the sheet width direction, in binding a bunch of sheets collected for each set on the processing tray by the stapling means (end binding stapling unit) 31 described later. In the case of an apparatus configuration for shifting the stapling means 31 to this position in binding a sheet corner, the apparatus is increased in size in the sheet width direction. Therefore, the apparatus shown in the figure offsets a bunch of sheets on the processing tray by driving shift motors MZ1, MZ2 of the left and right aligning plates 34L, 34R in the same direction by the same amount in the corner stapling mode.

[Configuration of Sheet-bunch Carrying-out Means]

Figure 4:
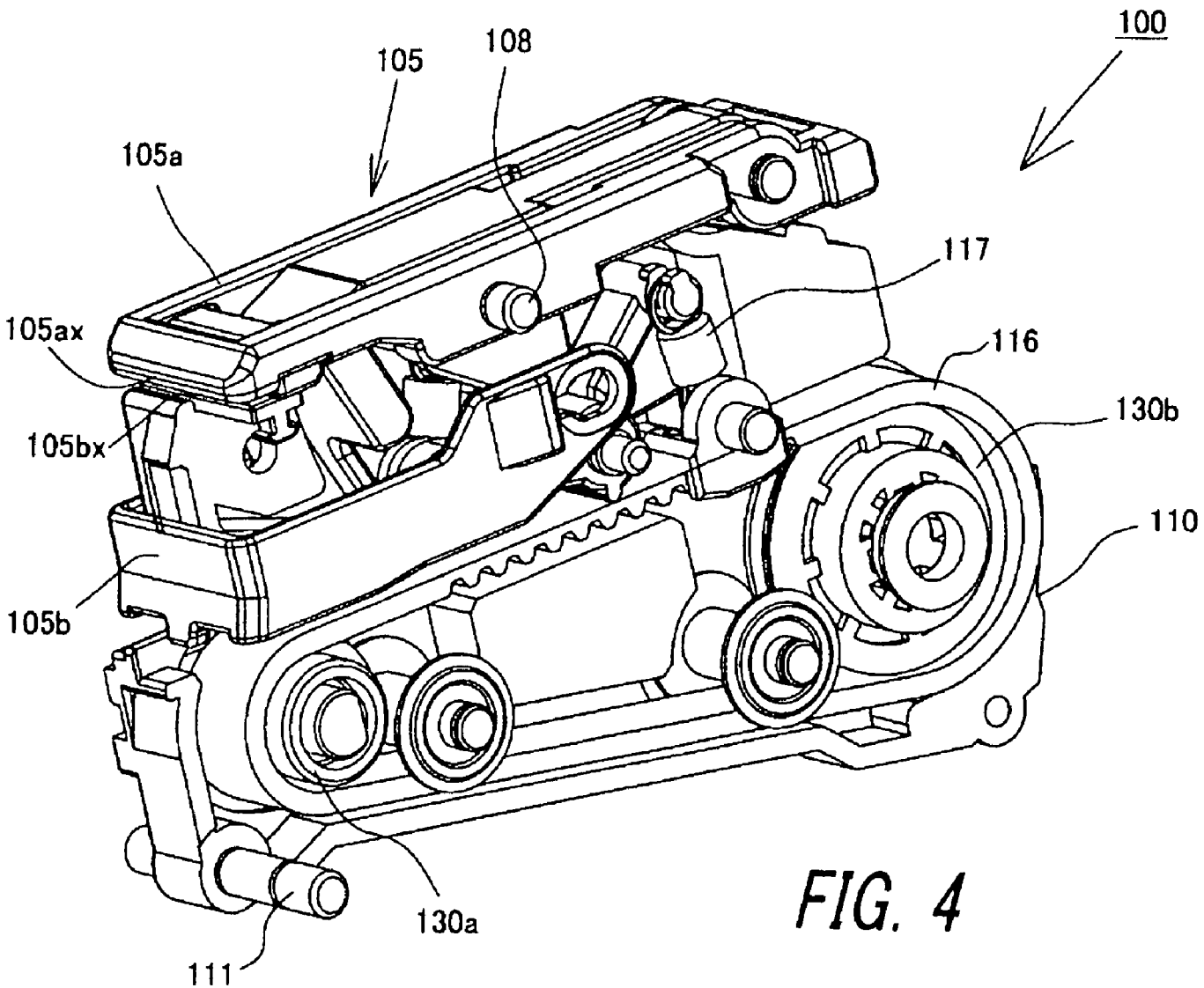
FIG. 4 is a perspective view showing an entire configuration of a sheet-bunch carrying-out means.
Figure 5:
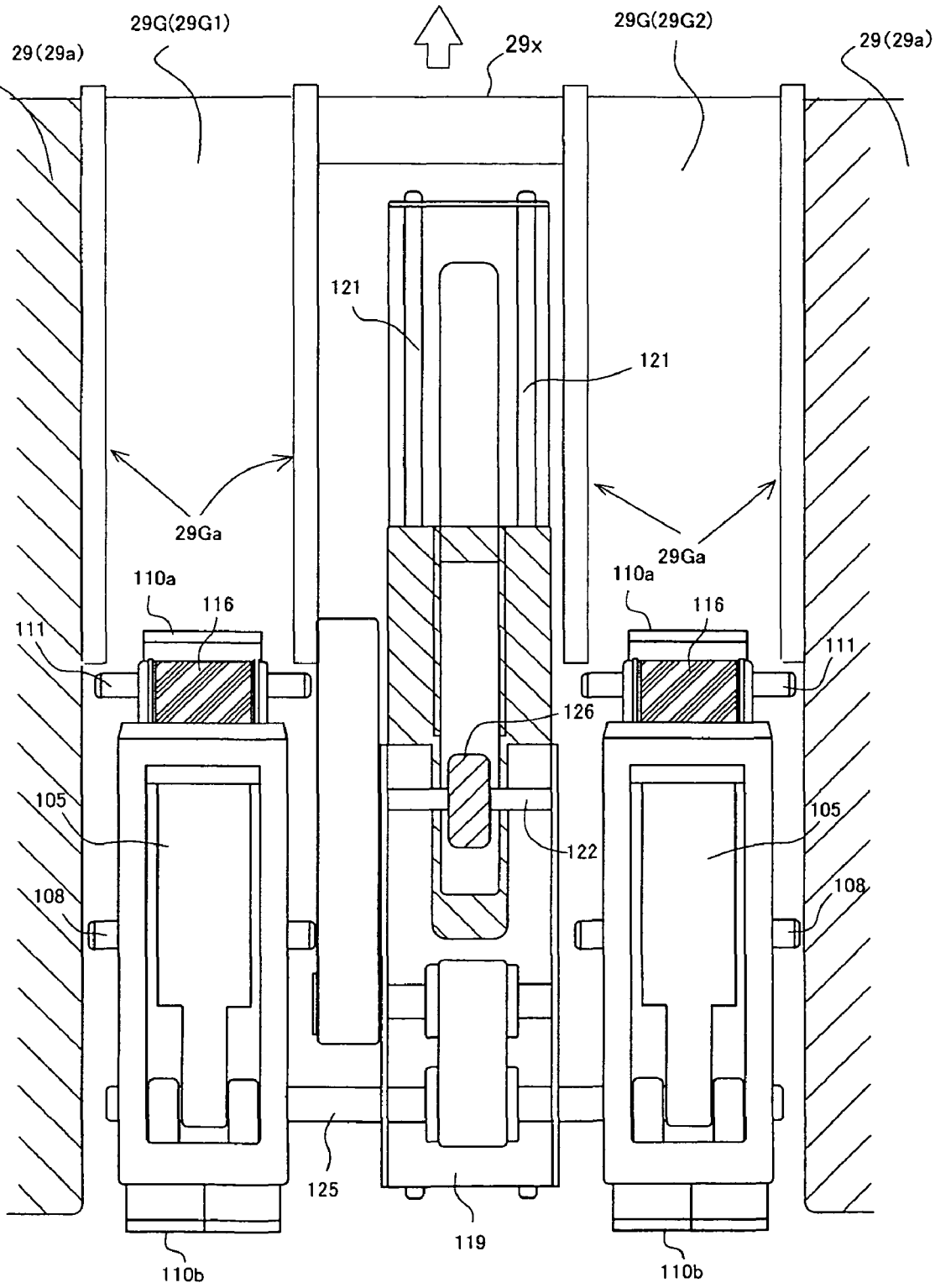
FIG. 5 is an explanatory view showing a planar structure of the sheet-bunch carrying-out means.
Figure 7:
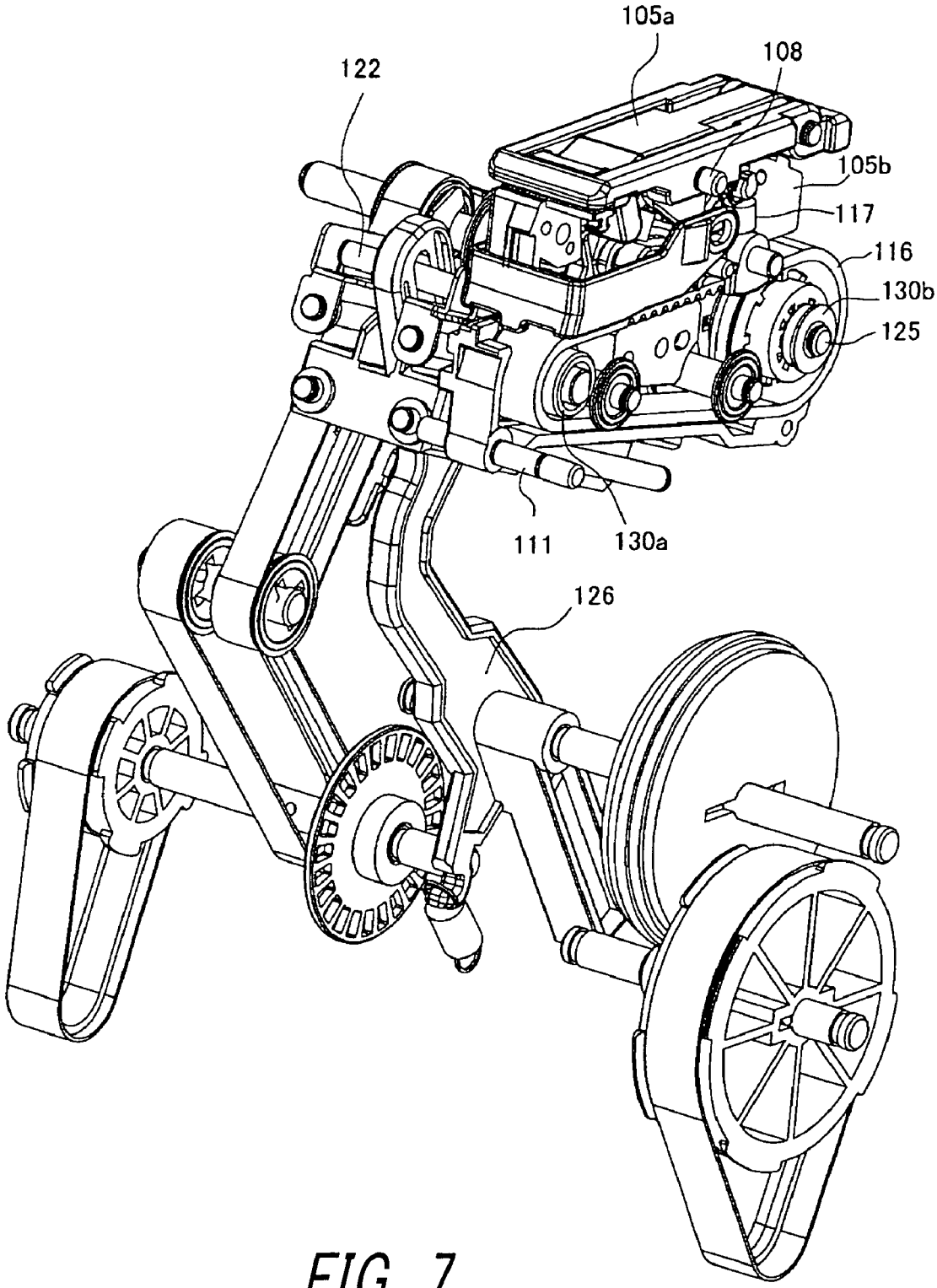
FIG. 7 is an explanatory view of a driving mechanism of the sheet-bunch carrying-out means.

In the processing tray 29 is disposed a sheet-bunch carrying-out means 100 for carrying out a bunch of processed sheets to the stack tray 21 on the downstream side. The sheet-bunch carrying-out means 100 is disposed in the bottom of the processing tray 29, and is formed of a sheet engagement member 105 which protrudes above the sheet support surface 29*a* and engages with a bunch of sheets, and a carrier member 110 that supports the sheet engagement member 15 mounted thereon. FIG. 4 is an explanatory view showing a perspective structure of the sheet-bunch carrying-out means 100, FIG. 5 is an explanatory view showing the planar structure, and FIG. 7 is an explanatory view of a driving mechanism.

As shown in FIG. 4, the sheet-bunch carrying-out means 100 is formed of the sheet engagement member 105, carrier member 110, engagement member driving means 127, and carrier-member driving means 114. The sheet engagement member 105 is formed of a movable gripper 105*a* and fixed gripper 105*b*. Further, the carrier member 110 is mounted with the sheet engagement member 105, and is configured to reciprocate between a base end portion (post-processing position) and a front end portion (bunch carrying-out position) of the processing tray 29. Each structure will be described below.

[Sheet Engagement Member]

The sheet engagement member 105 is formed of an engagement member such as a protruding piece, gripper or the like for engaging with a rear end edge of a bunch of sheets collected on the processing tray, and is disposed inside a guide groove 29G formed on the sheet support surface 29*a* of the processing tray 29. As shown in FIG. 5, in the processing tray 29, the guide groove 29G is formed in the sheet-bunch carrying-out direction (hereinafter, simply referred to as a "bunch carrying-out direction") between the processing position and the stack tray 21 disposed on the downstream side of the processing tray 29. In the apparatus as shown in the figure, two guide grooves 29G1, 29G2 are formed spaced apart from each other in the sheet width direction, and the sheet engagement member 105 is disposed in each of the left and right guide grooves 29G1, 29G2 as described below.

Figure 8A:
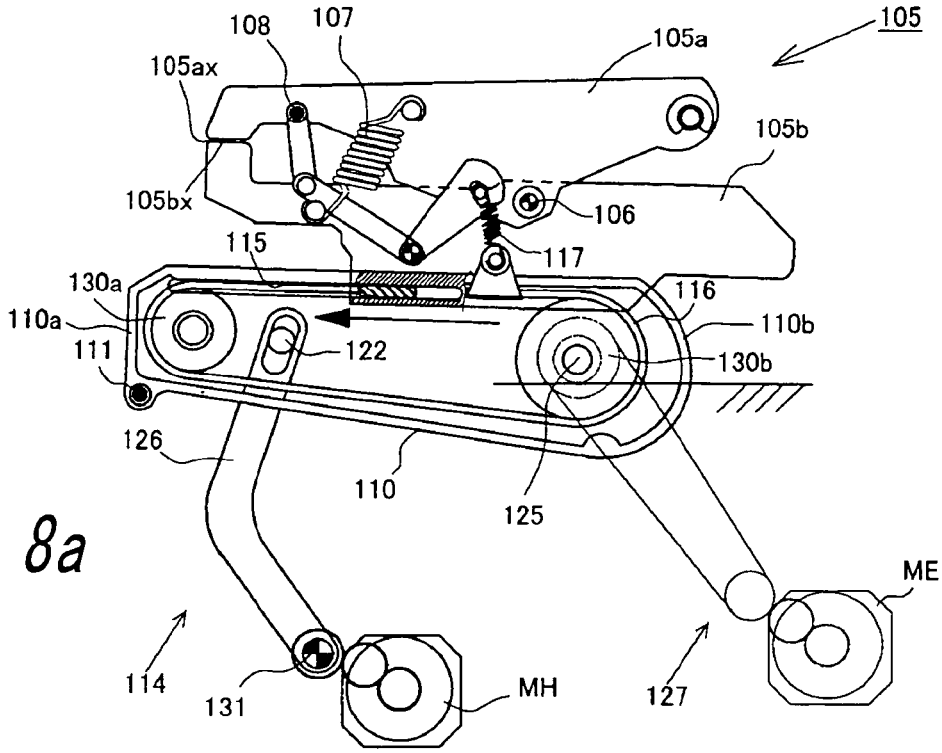
FIGS. 8*a*, 8*b* and 9*c* are explanatory views of a grip mechanism of the sheet-bunch carrying-out mechanism, where

The sheet engagement member 105 as shown in the figure is formed of a gripper mechanism for gripping the rear end edge of a bunch of sheets on the processing tray 29 to carry out. As shown in FIGS. 4 and 8, the movable gripper 105*a* and fixed gripper 105*b* are coupled by a pivot pin (coupling pin) 106 to mutually pivot. Then, a biasing spring 107 is provided between the movable and fixed grippers, and a front-end nip portion 105*ax* of the movable gripper 105*a* and a front-end nip portion 105*bx* of the fixed gripper 105*b* are always brought into contact with each other by pressuring (see FIG. 8*a*).

Then, the fixed gripper 105*b* is fitted and supported in the guide groove 115 formed in the carrier member 110 to be able to move to positions in the carrying-out direction. Further, the rear end portion of the movable gripper 105*a* is coupled to a traveling belt 116 incorporated into the carrier member 110 by a coupling spring 117. Accordingly, when the traveling belt 116 of the carrier member 110 described later travels leftward as viewed in FIG. 8, the fixed gripper 105*b* and movable gripper 105*a* shift in the sheet-bunch carrying-out direction with the front-end nip portions 105*ax* and 105*bx* pressed and brought into contact with each other (state of FIG. 8). When the traveling belt 116 inversely travels rightward as viewed in FIG. 8, the movable gripper 105*a* pivots clockwise about the pivot pin 106 as the center, and the front-end nip portion 105*ax* separates from the front-end nip portion 105*bx* of the fixed gripper 105*b* to release the nip (state of FIG. 8*b*).

[Carrier Member]

Described next is the carrier member 110 mounted with the above-mentioned sheet engagement member (hereinafter, a "gripper member (means)") 105 to support. As shown in FIGS. 4 and 8, the carrier member 110 is formed of a frame member with an appropriate shape for supporting the gripper member (means) 105, and is supported movable in the sheet-bunch carrying-out direction along the guide groove 29G formed in the processing tray 29.

The support structure will be described. A rear end portion 10*b* of the carrier member 110 is supported to reciprocate linearly along a slide member 119 as shown in FIG. 5. Meanwhile, a front end portion 110*a* of the carrier member 110 reciprocates while drawing a loop along loop guide grooves 29Ga described below. By this means, the gripper member (means) 105 mounted on the carrier member 110 shifts from a standby position to a carrying-out position by an upper path protruding above the processing tray, and returns to the standby position by a lower path sinking in the processing tray after carrying out a bunch of sheets to the stack tray 21. "111" shown in the figure denotes a guide pin provided at the front end portion of the carrier member 110, and is fitted with the loop guide groove 29Ga.

[Slide Member]

As shown in FIG. 5, the slide member 119 is fitted and supported with guide rails 121 disposed in the bottom of the processing tray 29, and supported to be able to reciprocate by a predetermined stroke in the same direction (vertical direction in FIG. 5) as that of the guide groove 29G. A driving rotary shaft 125 is laid over the slide member 119, and the rear end portion 110*b* of the carrier member 110 is axially coupled to the driving rotary shaft 125. FIG. 8 shows a state of this axially coupling, where the carrier member 110 is coupled to reciprocate in a predetermined stroke in the sheet-bunch carrying-out direction by the driving rotary shaft 125 in the rear end portion 110*b*, while the front end portion 110*a* is pivotable about the driving rotary shaft 125. In addition, the slide member 119 is coupled to a driving arm (crank member) 126 described later, and reciprocates between a predetermined stroke by the driving arm (crank member) 126. Further, the driving rotary shaft 125 is coupled to a driving pulley of the traveling belt 116 described later, and further, coupled to the engagement member driving means 127.

[Loop Guide Groove]

Figure 6:
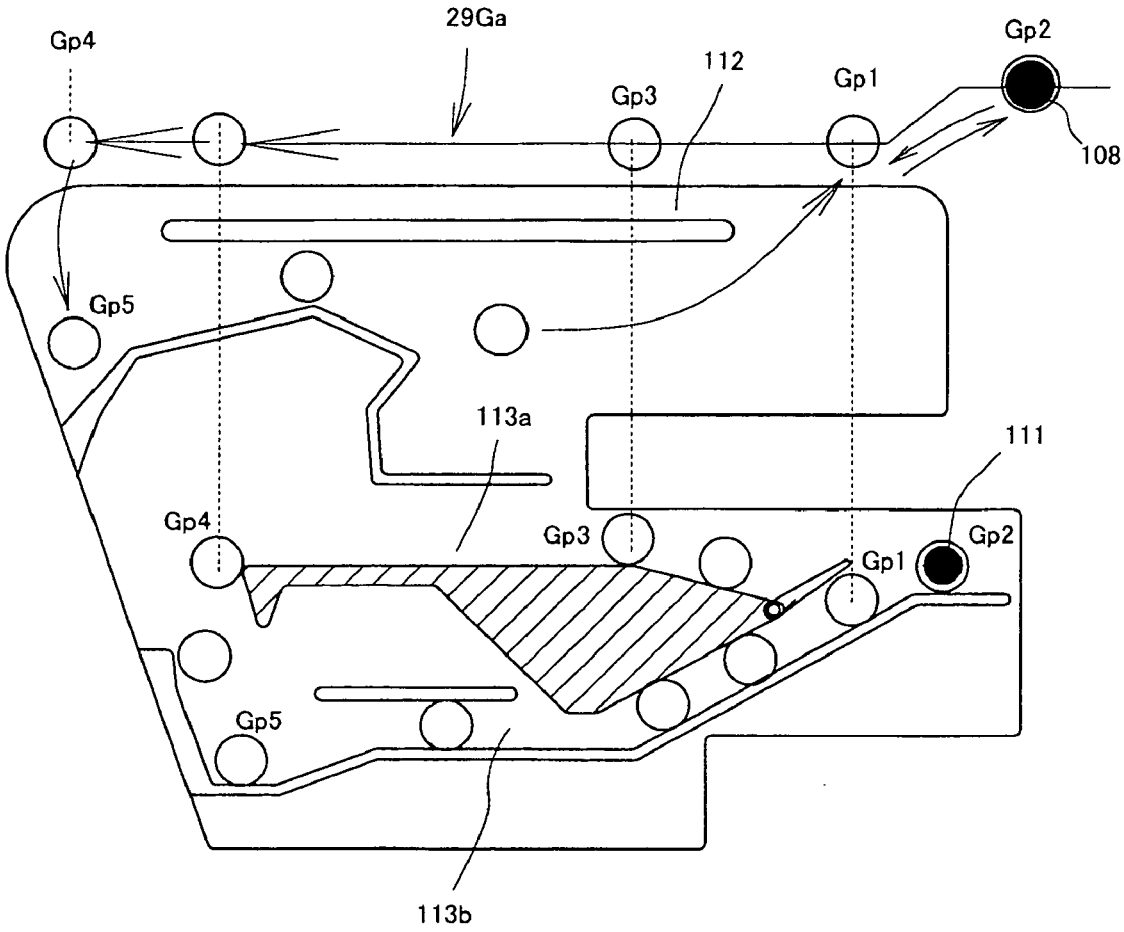
FIG. 6 is an explanatory view of a guide mechanism of the sheet-bunch carrying-out means.

The mutually opposite loop guide grooves 29Ga are formed on left and right side walls of the guide groove 29G (see FIG. 5). The guide pin 111 formed in the front end portion 110*a* of the carrier member 110 is fitted and supported with the loop guide grooves 29Ga. As shown in FIG. 6, each loop guide groove 29Ga is formed in the shape of a loop having an upper traveling path 113*a* and lower traveling path 113*b* along the sheet support surface 29*a* of the processing tray. Then, the guide pin 111 travels (outward) from the standby position to the carrying-out position along the upper traveling path 113*a*, and travels (homeward) from the carrying-out position to the standby position along the lower traveling path 113*b*.

As described above, when the carrier member 110 supported by the slide member 119 and loop guide grooves 29Ga travels from the standby position to the stack tray 21 side as shown in FIG. 6, the guide pins 111 track the upper traveling path 113*a*, and the carrier member 110 thereby travels in the substantially horizontal attitude. Meanwhile, when the carrier member 111 returns to the standby position from the stack tray 21, the guide pins 111 track the lower traveling path 113*a*, and the carrier member 110 thereby travels while tilting.

Further, as shown in FIG. 6, in the guide groove 29G is provided a loop groove 112 for guiding a guide pin 108 provided in the sheet engagement member (movable gripper member) 105*a*. The movable gripper 105*a* and fixed gripper 105*b* travel along the loop groove 112.

Then, as described later, the sheet engagement member (gripper member) 105 mounted on the carrier member 110 is in an operation attitude protruding above the processing tray 29 when the guide pins 111 of the carrier member 110 are guided by the upper traveling path 113*a* and travel in the sheet-bunch carrying-out direction, while being in a standby attitude sinking in the guide groove when the guide pints 111 are guided by the lower traveling path 113*b* and travel to the standby position. These states will be described later according to FIGS. 10 to 12.

Thus configured carrier member 110 is provided with a pair of pulleys, 130*a*, 130*b*, at the front and back in the sheet-bunch carrying-out direction as shown in FIG. 8, and the traveling belt 116 is looped between the pulleys. Then, one driving pulley 130*b* is axially supported on the driving rotary shaft 125 described previously. Accordingly, by rotation of the driving rotary shaft 125, the sheet engagement member (gripper member) 105 is configured to be movable between a base-end storing position (state of FIG. 10*a* described later) overlapping with the carrier member 110 and a front-end carrying-out position (state of FIG. 12*h* described later) protruding from the carrier member 110 in the sheet-bunch carrying-out direction.

[Installation Structure of the Sheet Engagement Member]

The carrier member 110 is disposed in the bottom of the processing tray 29, and the sheet engagement member (gripper member) 105 is mounted on the top of the carrier member 110. In the sheet engagement member (gripper member) 105, as described previously, the movable gripper 105*a* is coupled to the upper portion of fixed gripper 105*b* with the pivot pin 106. Then, the fixed gripper 105*b* is supported by the carrier member 110 to be able to move to positions in the sheet-bunch carrying-out direction. "115" shown in the figure denotes the slide guide groove formed in the carrier member 110, and the fixed gripper 105*b* is fitted and supported with the guide groove 115. Further, the movable gripper 105*a* is supported by the fixed gripper 105*b* to be pivotable by the pivot pin 106, and the rear end portion is coupled to the traveling belt 116 incorporated into the carrier member 110 by the coupling sprint 117. The carrier member 110 and sheet engagement member (gripper member) 105 are respectively provided with the carrier driving means 114 and engagement member driving means 127 as shown in FIGS. 7 and 8.

[Carrier Driving Means]

As shown in FIG. 5, the carrier member 110 is coupled (connected) to the slide member 119 with the driving rotary shaft 125. Then, as conceptually shown in FIG. 8, the slide member 119 is integrally formed with a shaft pin 122, and the driving arm 126 is fitted with the shaft pin 122. The driving arm 126 is coupled to a driving motor MH to pivot about a pivot shaft 131 axially supported on the apparatus frame by the crank member. Then, the driving arm 126 and shaft pin 122 are coupled in a slit (long-hole) manner. Accordingly, when the driving arm 126 is moved back and forth by a predetermined angle by the driving motor MH, the slide member 119 reciprocates back and forth in a predetermined stroke. By back-and-forth motion of the driving arm 126, the rear end portion 110*b* of the carrier member 110 moves back and forth with a linear locus, while the front end portion 110*a* moves back and forth with a loop locus along the loop guide groove 29Ga. Thus, the carrier member 110 is provided with the carrier driving means 114 that moves the carrier member 110 to positions in the sheet-bunch carrying-out direction along the processing tray 29.

[Engagement Member Driving Means]

The fixed gripper 105*b* and movable gripper 105*a* forming the sheet engagement member (gripper member) 105 are mutually coupled with the pivot pin 106. Then, the fixed gripper 105*b* is supported by the carrier member 110 to be able to move back and forth in the sheet-bunch carrying-out direction along the slide guide groove 115. Further, the rear end portion of the movable gripper 105*a* is coupled to the traveling belt 116 of the carrier member 110 by the coupling sprint 117 (see FIG. 8 for the aforementioned description). Then, as conceptually shown in FIG. 8, in the traveling belt 116 provided in the carrier member 110, the driving pulley 130*b* thereof is coupled to a driving motor ME. The driving motor ME is formed of a motor capable of rotating forward and backward, and the traveling belt 116 moves leftward as viewed in FIG. 8 when the motor ME is rotated forward. According to moving of the traveling belt 116, the movable and fixed grippers 105*a*, 105*b* move (bunch carrying-out direction) from the standby position to the carrying-out position along the slide guide groove 115.

Figure 8B:
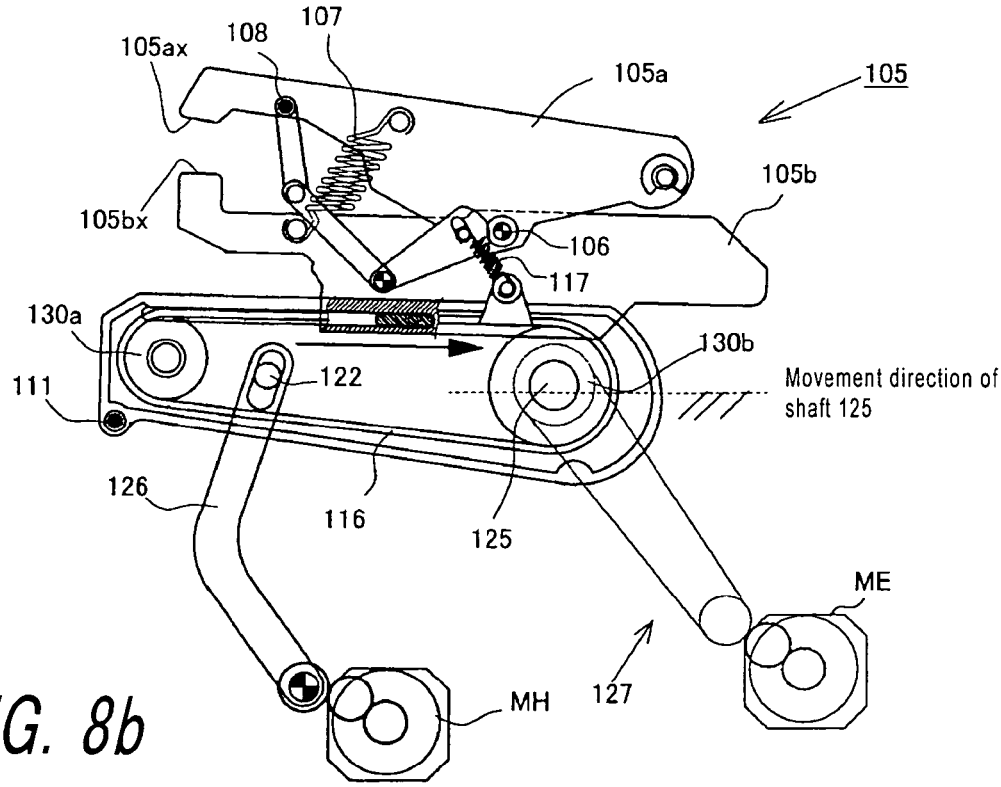
Figure 9C:
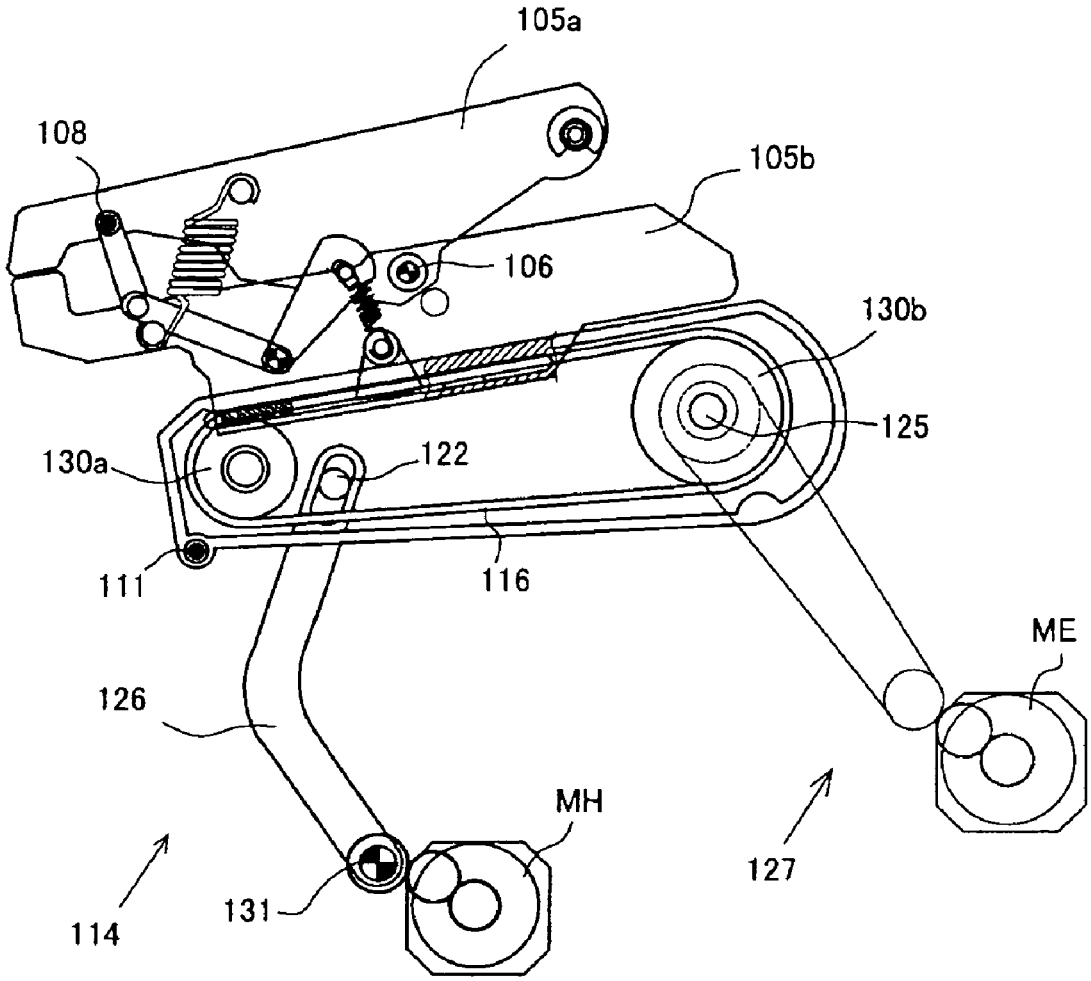

Further, when the driving motor ME is rotated backward, as shown in FIG. 8*b*, the movable and fixed grippers 105*a*, 105*b* move from the carrying-out position to the standby position (in the return direction). Concurrently with the movement, when the traveling belt 116 further travels from the standby position to the back side, the coupling spring 117 moves clockwise according to the driving pulley 130*b*. By the backward operation of the driving pulley 130*b*, the coupling spring 117 pulls the rear end portion of the movable gripper 105*a* downward. At this point, the movable gripper 105*ax* rotates clockwise about the pivot pin 106, and the nip portion 105*ax* at the front end is extended upward to open (see FIG. 8*b*). Thus, the sheet engagement member (gripper member) 105 is provided with the engagement member driving means 127 for moving the sheet engagement member (gripper member) 105 to positions in the sheet-bunch carrying-out direction along the carrier member 110.

[Operation of the Sheet Engagement Member]

The operation of the sheet engagement member (gripper member) 105 configured as described above will be described below based on FIGS. 10*a* to 12*k*. Although a configuration of its control means will be described later, the gripper means (gripper member) 105 is controlled to move to "first standby position Gp1", "second standby position Gp2", "nip position Gp3", "bunch carrying-out position Gp4", "nip releasing position Gp5", and "first standby position Gp1" in this order.

[First Standby State]

Figure 10A:
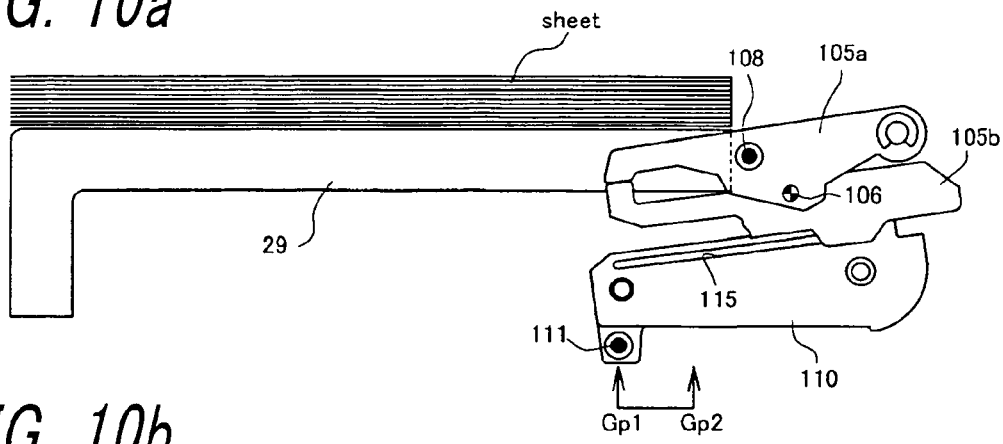
FIGS. 10*a* to 10*d* are operating state explanatory views of the sheet-bunch carrying-out means, where
Figure 10B:
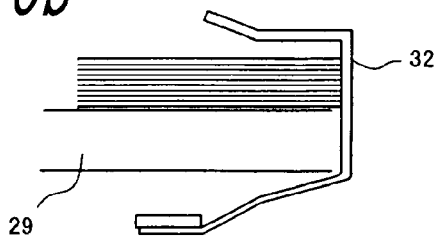
Figure 10C:
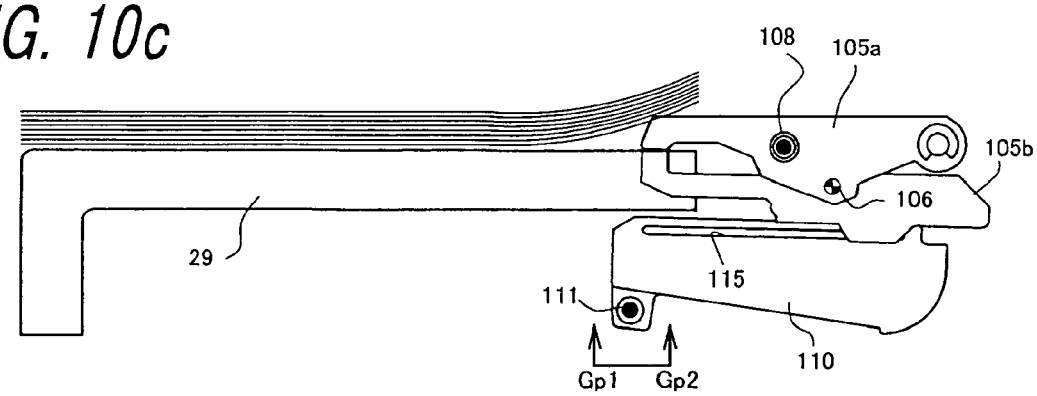

The control means 167 described later moves the gripper means (gripper member, which is the same in the following) 105 to the first standby position Gp1 as shown in FIG. 10*a* by the "initial operation" (describe later) in starting the apparatus. In this first standby position Gp1, the gripper means 105 is in a standby attitude sinking in the guide groove 29G of the processing tray 29. In this attitude, sheets carried onto the processing tray 29 are pushed against the sheet end regulating means 32 and aligned as shown in FIG. 10*b*. Accordingly, in this attitude, sheets from the sheet discharge outlet 25*x* are collected for each set on the processing tray 29, and undergo post-processing in a beforehand set processing position of a bunch of sheets.

[Backward Operation of the Gripper Means]

Figure 10D:
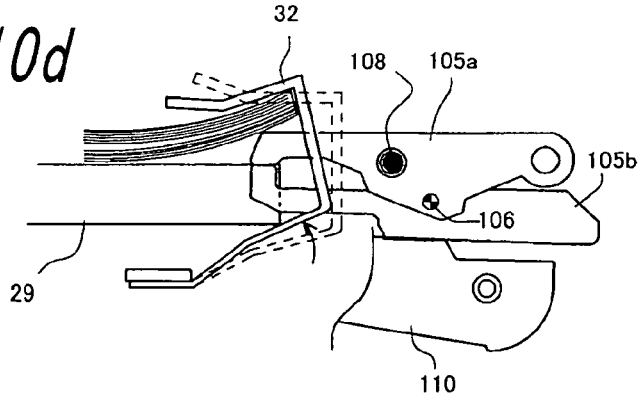

Upon receiving a job finish signal from the image formation apparatus A, the control means 167 backs the gripper means 105 toward the second standby position Gp2. Therefore, the control means 167 rotates the driving motor MH of the driving arm 126 backward by a predetermined amount. In the process of backing toward the second standby position Gp2, in the gripper means 105, the guide pins 111 of the carrier member 110 shift to the upper traveling path 113*a* from the lower traveling path 113*b* of the loop guide groove 29Ga, and the movable gripper 105*a* protrudes above the sheet support surface 29*a* (see FIG. 10*c*). At this point, sheet front ends are pushed upward by the movable gripper 105*a*, and the sheet end regulating means 32 elastically deforms, follows the sheet front ends, and bends to deform upward as shown in FIG. 10*d*. By this means, smooth movement of the gripper means 105 is ensured.

[Second Standby Position State]

Then, the control means 167 rotates the driving motor MH of the driving arm 126 backward by a predetermined amount, and halts the motor. Then, the control means 167 rotates the driving motor ME of the driving pulley 130*b* provided in the carrier member 110 clockwise (see FIGS. 8*a* and 8*b*). Upon the rotation, the movable gripper 105*a* shifts from a nip attitude of FIG. 10*c* to a nip releasing attitude of FIG. 11*e*. In this state, the gripper means 105 is positioned in the second standby position Gp2.

[Nip Operation]

Next, the control means 167 rotates the driving motor MH of the driving arm 126 forward (counterclockwise in FIG. 8*a*), and moves the carrier member 110 in the bunch carrying-out direction. By this movement, the sheet engagement member is positioned in the nip position (sheet end regulating member position). Then, the control means 167 rotates the driving pulley 130*b* of the carrier member 110 clockwise (see FIGS. 8*a* and 8*b*). Upon the rotation, the movable gripper 105*a* coupled to the traveling belt 116 is brought into contact with the fixed gripper 105*b* while being pressed to nip the sheet-bunch. The control means 167 moves the carrier member (moving velocity Vc) in the direction opposite to the moving direction (moving velocity Vb) of the gripper means 105 moved by the traveling belt 116. At this point, by adjusting the moving velocity Vb of the traveling belt 116 with respect to the moving velocity Vc of the carrier member 110, it is possible to rest the gripper member 105. In other words, by moving the gripper member 105 in the direction opposite to the moving direction of the carrier member 110 with respect to the sheets on the processing tray, the gripper means 105 is at rest with respect to the sheets. For example, when the velocities Vc and Vb are the same velocity, the equation of Vc=−Vc holds, and the gripper means 105 remains at rest. By this means, the gripper means 105 performs the grip operation from the release attitude to the nip attitude while resting with respect to the sheets.

Figure 11E:
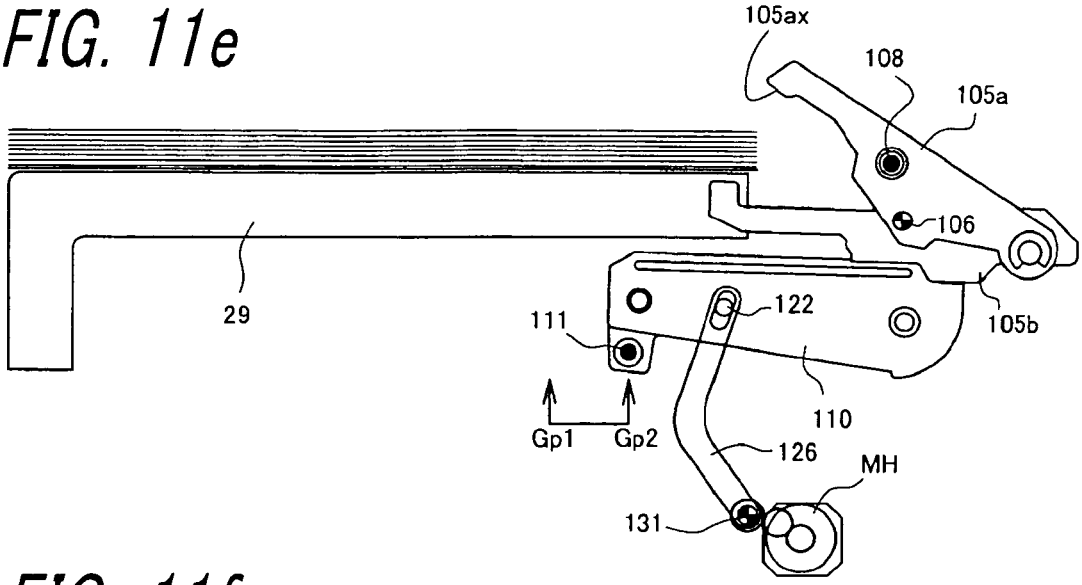
FIGS. 11*e* to 11*g* are operating state explanatory views of the sheet-bunch carrying-out means, where
Figure 11F:
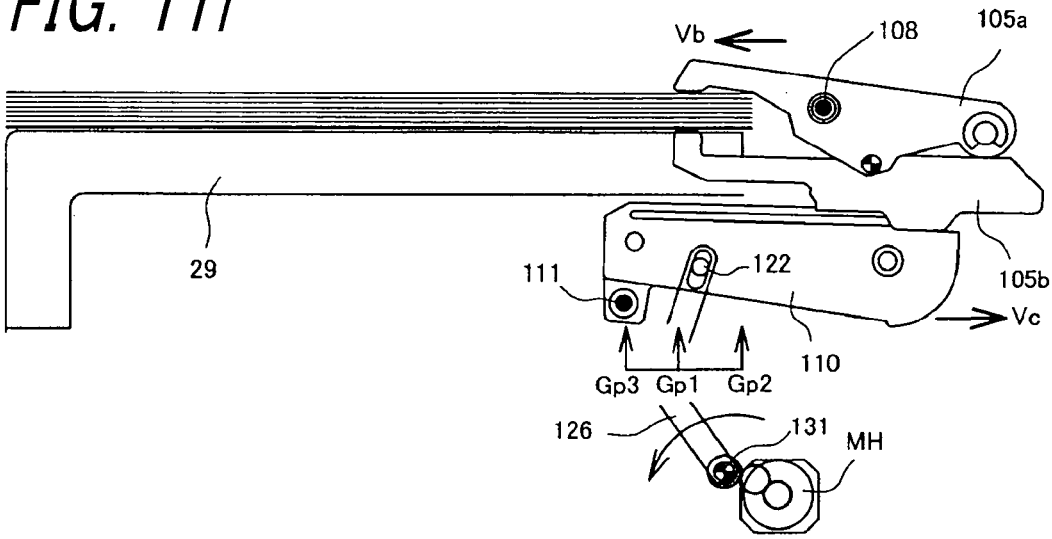

Then, the control means 167 continues the forward rotation of the driving motor MH of the driving arm 126, and concurrently therewith, rotates the driving pulley 130*b* of the carrier member 110 counter clockwise (see FIGS. 8*a* and 8*b*). Upon the rotation, as described in FIGS. 8*a* and 8*b*, movement of the traveling belt 116 loosens the coupling spring 117, and the movable gripper 105*a* is pressed and brought into contact with the fixed gripper 105*b*, and at this point, nips the rear end portion of a bunch of sheets on the processing tray. This state is shown in FIG. 11*f*.

[Bunch Carrying-out Position Movement]

The control means 167 halts the driving pulley 130*b* of the carrier member 110, and continues the forward rotation of the driving motor MH of the driving arm 126. Upon the rotation, the bunch of sheets nipped by the gripper means 105 are moved from the state of FIG. 11*f* to a state of FIG. 11*g* along the processing tray 29. In a state where the bunch of sheets are moved to the carrying-out position in the state of FIG. 11*g*, the control means 167 rotates the driving pulley 130*b* of the carrier member 110 counterclockwise. Upon the rotation, the fixed and movable grippers 105*a*, 105*b* coupled to the traveling belt 116 protrude to above the processing tray from the carrier member 110 in a state of FIG. 12*h*. By this means, the rear end of the bunch of sheets is carried out above the stack tray 21, and the front end thereof is stored on the uppermost sheet on the tray.

[Nip Release State]

Next, the control means 167 temporarily halts the driving motor MH of the driving arm 126. Upon the halt, the carrier member 110 falls in the loop guide groove 29Ga. The gripper means 105 thereby falls onto the uppermost sheet on the tray in a state of FIG. 12*i*. Then, the control means 167 rotates the driving motor MH of the driving arm 126 backward. Upon the rotation, the carrier member 110 returns to the first standby position side along the lower traveling path 113*b* of the loop guide groove 29Ga. At this point, the bunch of sheets nipped by the gripper means 105 are stopped by the tray side wall, and released from the nip (state of FIG. 12*j*).

[Return State]

Further, the control means 167 continues the rotation of the driving motor MH of the driving arm 126 to return the carrier member 110 to the first standby position Gp1 from the bunch carrying-out position Gp4. Then, the gripper member 105*a* returns to the state of sinking in the guide groove 29G of the processing tray 29 in a state of FIG. 12*k*.

[Configuration of the End Edge Binding Stapling Unit]

Figure 15A:
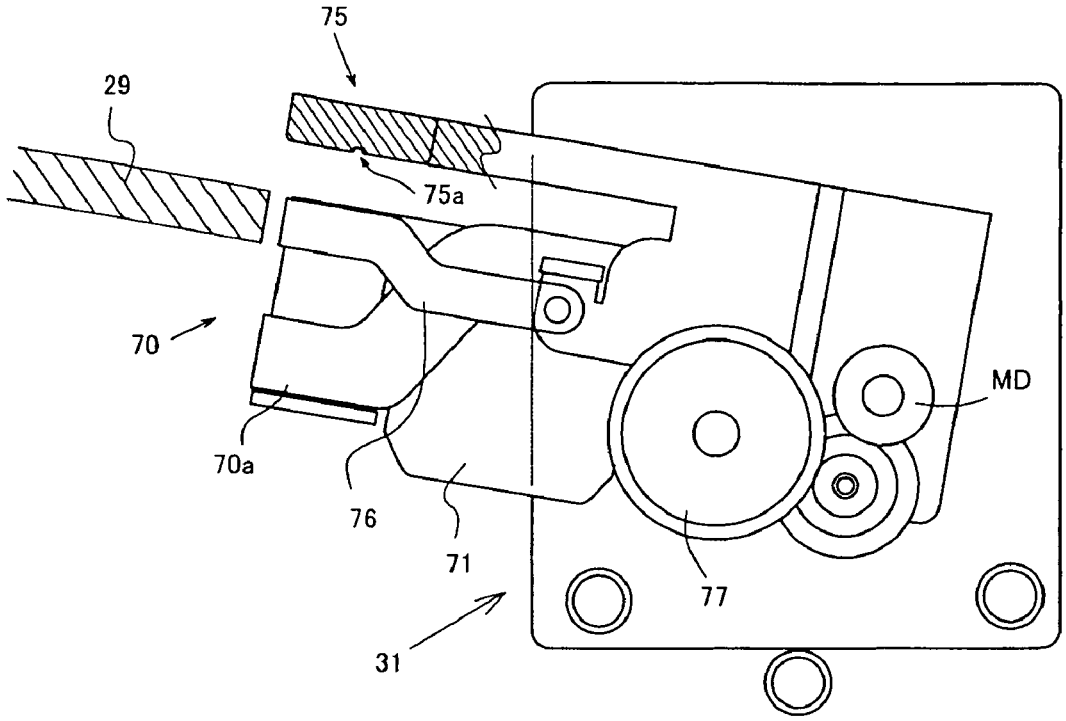
FIGS. 15*a* and 15*b* are explanatory views of an end binding stapling means in the apparatus of FIG. 2, where
Figure 15B:
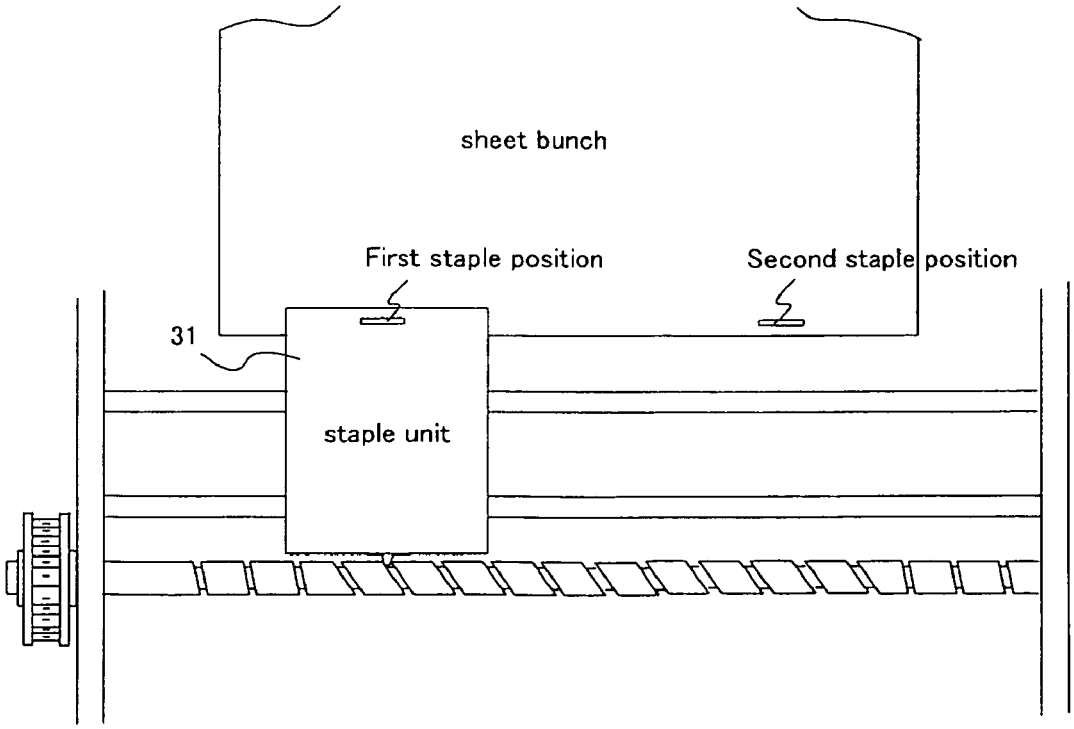

The aforementioned post-processing means (stapling means) 31 is formed of a driver 70 and clincher 75 as shown in FIG. 15*a*. The driver 70 is formed of a head member 70*a* that inserts a staple into a bunch of sheets set in the binding position, cartridge 71 for storing staples, driver cam 77, and staple motor MD for driving the driver cam 77. The clincher 75 is formed of a bend groove 75*a* to bend the front end of the staple inserted into a bunch of sheets. Then, in the end binding stapling unit (post-processing means) 31, the driver 70 and clincher 75 are integrally attached to a unit frame, and the head member 70*a* reciprocates vertically as viewed in FIG. 15*a* by the driver cam 77, and incorporates a former 73 and bending block 74.

[Lifting/Lowering Mechanism of the Stack Tray]

A configuration of the stack tray 21 will be described below according to FIG. 13. The stack tray (hereinafter, referred to as an "up-and-down tray") 21 is configured to move up and down corresponding to a load amount of sheets. The up-and-down tray 21 is formed in the shape of a tray for holding sheets, and configured to protrude outside the apparatus from the side wall of the casing 20. Therefore, as shown in FIG. 13, a tray base end portion 21*a* is provided at its lower and upper portions with two guide rollers 20*r*, and the guide rollers 20*r* are fitted and supported with an up-and-down guide 20*u* provided in the apparatus frame (not shown).

Then, the up-and-down tray 21 is installed in its bottom with a lifting/lowering motor (shift means) MS, and a driving pinion 21*p* is coupled to the lifting/lowering motor MS via a reduction mechanism. Meanwhile, in the apparatus frame provided with the up-and-down guide 20*u* is disposed a rack 20*h* in the sheet load direction (vertical direction as viewed in FIG. 13), and the driving pinion 21*p* meshes with the rack 20*h*. Meanwhile, the lifting/lowering motor MS is formed of a motor capable rotating forward and backward, and its driving shaft is provided with an encoder (not shown) for detecting the amount of rotation. Further, the up-and-down tray 21 is provided with a level sensor Sr for detecting a height position of the uppermost sheet loaded on the up-and-down tray 21. Accordingly, the up-and-down tray 21 moves to positions in the sheet load direction (vertical direction as viewed in FIG. 13) by rotating the lifting/lowering motor MS forward and backward by a predetermined amount. Then, the level sensor Sr detects a height position of the up-and-down tray 21, and based on the detection result, the lifting/lowering motor MS is driven and rotated forward or backward. The amount of rotation of the lifting/lowering motor MS is detected by the encoder.

[Configuration of the Level Sensor]

Figure 13:
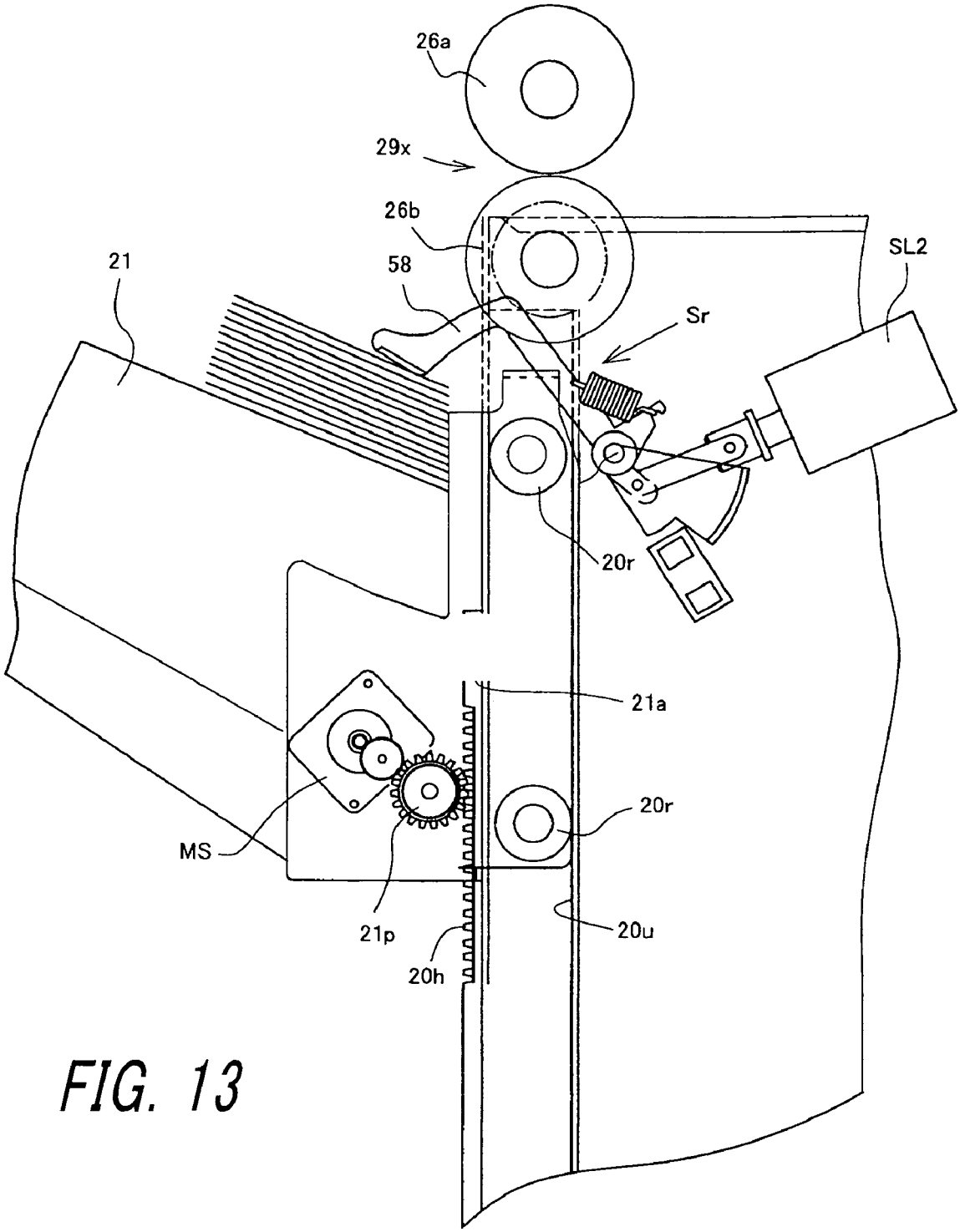
FIG. 13 is an explanatory view of a lifting/lowering mechanism of the stack tray in the apparatus of FIG. 3.

As shown in FIG. 13, the level sensor Sr is formed of an arm lever 58, and a sensor for detecting a position of the arm lever 58, and the arm lever 58 is coupled to an operation solenoid SL2. Then, a lifting/lowering means 164 moves the arm lever 58 up and down with a sheet discharge instruction signal. The sheet discharge instruction signal is a timing signal after a lapse of predicted time that a sheet reaches the stack tray 21, for example, after a rear end pass signal of the sheet from the sheet discharge sensor S2, or after a lapse of predicted time that a rear end of a bunch of sheets reaches the stack tray after an operation signal of the bunch carrying means described previously.

[Lifting/Lowering Control Means]

The lifting/lowering control means (control CPU 161 as described later) 164 for controlling the lifting/lowering motor (shift means) MS is configured in the following way. Described first are control modes for carrying a sheet from the sheet discharge outlet 25*x* onto the stack tray. A sheet is carried out from the sheet discharge outlet 25*x* in a "straight sheet discharge mode (second sheet discharge operation mode)", "bridge carrying-out mode (first sheet discharge operation mode)", or "processed bunch carrying-out mode". The carrying-out mode is selected, for example, in setting the post-processing mode of the image formation apparatus A.

Figure 14A:
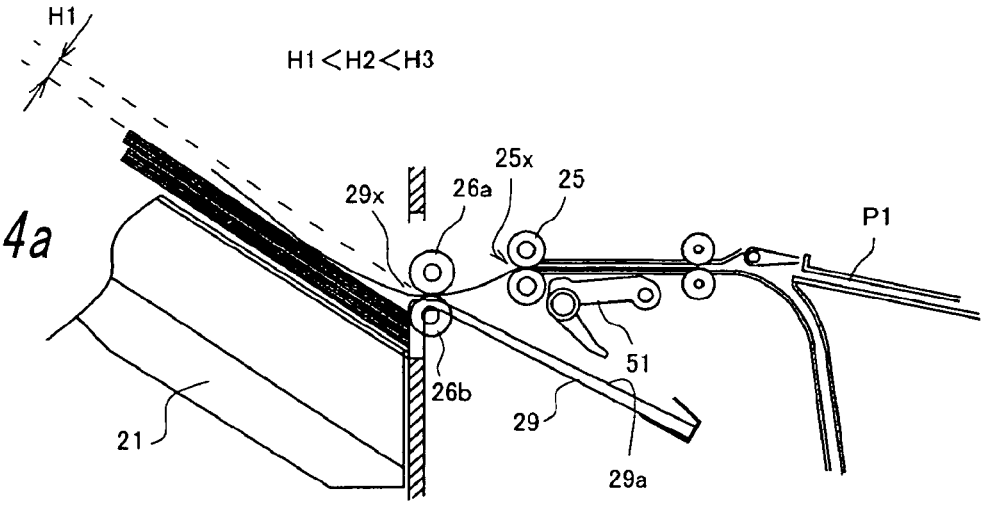
FIGS. 14*a* to 14*c* are explanatory views of rising and lowering states of the stack tray in the apparatus of FIG. 3, where

Then, the "straight sheet discharge mode (second sheet discharge operation mode)" is to directly carry out a sheet with an image formed thereon from the sheet discharge outlet 25*x* without performing post-processing. In this mode, the sheet sent to the carry-in entrance 23*a* is sent to the first carry-in path P1, and carried out onto the processing tray 29 via the sheet discharge rollers 25 and sheet discharge sensor S2. On the processing tray 29, the switch back roller 26*a* rotates in the sheet discharge direction (clockwise as viewed in FIG. 14*a*) while being in pressure-contact with the following roller 26*b* disposed on the sheet support surface 29*a*. Accordingly, the sheet from the sheet discharge outlet 25*x* is carried out onto the processing tray 29, sent onto the up-and-down tray 21 by the switch back rollers 26*a*, 26*b* prepared on the tray, and loaded on the upper most sheet.

The "bridge carrying-out mode (first sheet discharge operation mode)" is to collect sheets with images formed thereon from the sheet discharge outlet 25*x* on the processing tray 29 for each set to perform post-processing. In this mode, a sheet sent to the carry-in entrance 23*a* is sent to the first carry-in path P1, and carried out to the processing tray 29 via the sheet discharge rollers 25 and sheet discharge sensor S2. In the processing tray 29 are prepared the sheet end regulating means 32, switch back roller 26*a*, aligning means 51, and side aligning means 34. Then, the sheet from the sheet discharge outlet 25*x* is collected in the shape of a bunch on the uppermost sheet. The "processed bunch carrying-out mode" is to carry out a bunch of sheets which are collected for each set on the processing tray and undergo biding processing by the end binding stapling means 31 from the processing tray 29 to the up-and-down tray 21. Therefore, the processing tray 29 is provided with the sheet-bunch carrying-out means 100 as described previously.

Then, the lifting/lowering control means 164 sets a height different H between the uppermost sheet stored in the up-and-down tray 21 and the sheet support surface 29*a* of the processing tray 29 at a first height position H1 in the "straight sheet discharge mode", at a second height position H2 in the "bridge carrying-out mode", and at a third height position H3 in the "processed bunch carrying-out mode". The height differences H are set to increase in the order of the first, second and third height positions (H1<H2<H3). The control of the height position is performed, as described previously, by detecting a position of the uppermost sheet on the tray by the level sensor Sr, and rotating the lifting/lowering motor MS by a predetermined amount with respect to the detection signal to set the height difference H.

The first height position H1 is set to make a height difference between the uppermost sheet and the sheet support surface 29*b* substantially zero. In other words, it is set to smoothly carry a discharged sheet sent to the sheet support surface 29*a* onto the uppermost sheet. At this point, considering that the rear end of the uppermost sheet curls and rises, and that the uppermost sheet is positioned upward by control error, the setting is made so that the uppermost sheet is slightly lower than the sheet support surface 20*a*.

Concurrently with such considerations, it is difficult to control the processing tray 29 to lower corresponding to a thickness of a single sheet whenever the sheet is carried in. Therefore, usually, the processing tray 29 is configured to lower after the level sensor Sr detects that the sheet is carried out from the sheet discharge outlet 25*x* repeatedly several times. Therefore, the first height position H1 is set at, for example, 5 mm to 10 mm.

Figure 14B:
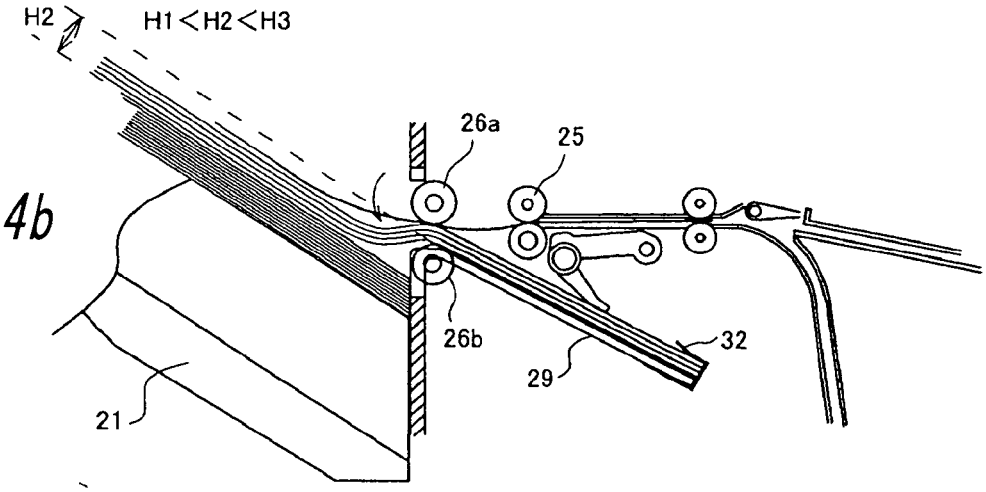
Figure 14C:
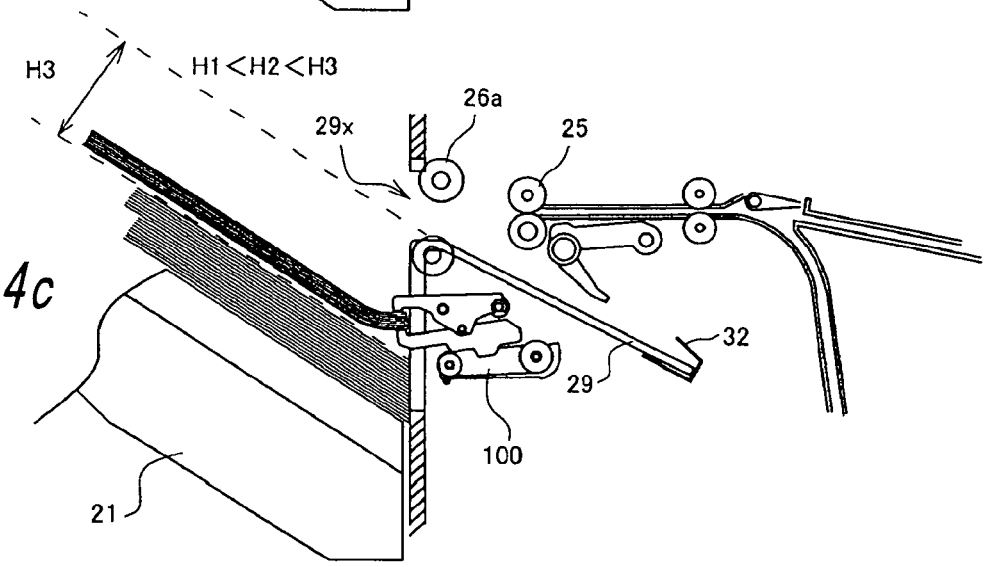

The second height position H2 is set so that the height difference between the uppermost sheet and the sheet support surface 29*a* is at least equal to or slightly greater than a bunch thickness of a bunch of sheets to load. This is because when the height difference therebetween is set at substantially zero, sheets carried out from the sheet discharge outlet 25*x* are gradually piled thereon, and a problem arises that the sheet collected on the top should be displaced while feeding out the uppermost sheet whenever carrying in. Concurrently with the displacement problem, when the up-and-down tray 21 is arranged to tilt so that the forward portion in the sheet discharge direction is higher (see FIG. 14*b*), a bunch of sheets collected on the processing tray 29 curve so that the front end side in the sheet discharge direction rises upward. The curving causes rear end edges (binding processing end) of sheets collected in the shape of a bunch for each set to become ragged, and when the sheets undergo binding processing in this state, the sheet end edges are displaced to the front and back and become ragged.

Therefore, the second height position H2 is formed to be a height difference greater than the first height position H1, and the height difference is experimentally determined from a position displacement amount of the processing end edge due to curving when a bunch of sheets with the maximum acceptable amount are loaded on the sheet support surface 29*a* of the processing tray. The second height position H2 shown in the figure is set at about 10 mm to 30 mm.

In moving the up-and-down tray 21 from the second height position to the third height position in the "processed bunch carrying-out mode", the lifting/lowering control means 164 controls the tray 21 to move from the second height position to the third height position by (i) starting the lifting/lowering motor MS using an operation completion signal of the stapling means 31 or a timing signal for starting the carrier member 110 to move in the sheet carrying-out direction by the operation completion signal, or controls the tray 21 to move from the second height position to the third height position by (ii) starting the lifting/lowering motor MS immediately before a binding-processed bunch of sheets reach the up-and-down tray 21 subsequently to an operation completion signal of the stapling means 31 and the sheet rear end falls onto the uppermost sheet.

Further, the lifting/lowering control means 164 controls the height difference (the third height position H3) between the sheet support surface 29*a* of the processing tray 29 and the up-and-down tray 21 so as to release the grip of the gripper member (means) 105 in the process during which the rear end of the bunch of sheets falls. Accordingly, the bunch of sheets gently fall onto the uppermost sheet by a small drop and are collected. It is thereby possible to maintain alignment of sheets collected on the up-and-down tray 21. With respect to the grip release of the gripper member (means) 105, as described previously based on FIG. 12*j*, the bunch of sheets are stopped by the tray side wall as the gripper means 105 moves in the return direction, and released from the nip. The nip releasing means (not shown) is comprised of traveling in the return direction of the gripper member 105 and the tray side wall (not shown).

[Explanation of the Control Configuration]

A control configuration of the image formation system as described above will be described below according to a block diagram of FIG. 16. The image formation system as shown in FIG. 1 is provided with a control section (hereinafter referred to as a "main body control section") 150 of the image formation apparatus A and a control section (hereafter referred to as a "post-processing control section") 160 of the post-processing apparatus B. The main body control section 160 is provided with an image formation control section 151, feeding control section 152 and input section 153. Then, the settings of "image formation mode" and "post-processing mode" are made from a control panel 18 provided in the input section 153. As described previously, the image formation mode is to set image formation conditions such as the number of print out sets, sheet size, color/monochrome printing, scaling printing, one-side/two-side printing and others. Then, the main body control section 150 controls the image formation control section 151 and feeding control section 152 corresponding to the set image formation conditions, forms an image on a predetermined sheet, and then, sequentially carries out the sheet from the main-body sheet discharge outlet 3.

Concurrently therewith, the post-processing mode is set by input from the control panel 18. For example, the "print-out mode", "end binding finish mode" or "sheet-bunch folding finish mode" is set. Then, the main body control section 150 transfers the finish mode of post-processing, the number of sheets, information of the number of sets, and binding mode (one-portion binding, two-portion binding, or multiple-portion binding) information to the post-processing control section 160. Concurrently therewith, the main body control section 150 transfers a job finish signal to the post-processing control section 160 whenever image formation is completed.

[Post-processing Control Section]

The post-processing control section 160 is provided with the CPU 161 for operating the post-processing apparatus B corresponding to the designated finish mode, ROM 162 for storing an operation program, and RAM 163 for storing control data. Then, the control CPU 161 is comprised of a "sheet feeding control section 164*a*" for executing feeding of a sheet sent to the carry-in entrance 23*a*, "punch control section 164*p*" for punching a hole in a sheet from the image formation apparatus A, "sheet collection operation control section 164*b*" for controlling collection of sheets for each set to the processing tray 29, "end binding operation control section 164*c*" for performing binding processing on a bunch of sheets collected on the processing tray 29, "folding processing control section 164*d*" for performing folding processing on a bunch of sheets collected on the collection guide 45, and "trimmer control section 164*t*" for cutting and aligning a bunch of sheets subjected to the folding processing.

[Sheet Feeding Control Section]

The sheet feeding control section 164*a* is coupled to a control circuit of a driving motor (not shown) of the sheet discharge rollers 25 of the first carry-in path P1, and is configured to receive a detection signal from the sheet sensor S1 disposed in this carry-in path. The sheet feeding control section 164*a* controls a path switching means 24 corresponding to the post-processing mode with respect to the sheet from the carry-in entrance 23*a*. This control is configured to guide the sheet to the first carry-in path P1 when the post-processing mode set in the image formation apparatus A is the "print-out mode" and "end binding finish mode". This control is to drive and rotate the carry-in rollers 23 and sheet discharge rollers 25 in the sheet discharge direction by a sheet discharge instruction signal from the image formation apparatus A, and operate the path switching means 24 to guide the sheet to the first carry-in path P1 based on a sheet detection signal from the sheet sensor S1. Meanwhile, when the "sheet-bunch folding finish mode" is selected as the post-processing mode, the path switching means 24 is operated to guide a sheet to the second carry-in path P2.

[Sheet Collection Operation Control Section]

The sheet collection operation control section 164*b* is configured to conduct the switch back rollers 26, aligning means 51 and bunch carrying-out means 100 when the post-processing mode is set at the "print-out mode" or "end binding finish mode". The sheet collection operation control section 164*b* is connected to a driving circuit of a lifting/lowering motor MY provided in the switch back roller 26 to collect sheets on the processing tray 29, and a driving circuit of a stepping motor MC provided in the aligning means 51. Then, the section 164*b* moves the switch back rollers 26 from a standby position to a sheet engagement position by a detection signal from the sheet discharge sensor S2 disposed in the sheet discharge outlet 25*x* so as to transfer sheets carried onto the processing tray 29 to the stack tray 21 side. Then, after a lapse of predicted time the sheet rear end is carried onto the tray, the section 164*b* reverses the direction of rotation of the switch back roller 26 to feed the sheets arranged on the processing tray to the sheet end regulating means 32.

Further, the sheet collection operation control section 164*b* is coupled to a driving circuit of the shift motors MZ1, MZ2 of the aligning plates 34L, 34R disposed on the processing tray. Then, the section 164*b* is configured to align the width of sheets fed by the switch back rollers 26 with the aligning plates 34L, 34R. Therefore, the sheet collection operation control section 164*b* is to cause the left and right aligning plates 34L, 34R to reciprocate in the sheet width direction in a predetermined range according to the sheet size.

The sheet collection operation control section 164*b* is configured to receive a detection signal from a sensor means (micro-switch) 138 disposed in the tray sheet discharge outlet 29*x*, and determine whether or not the tray sheet discharge outlet 29*x* is opened by a signal from the sensor means 138. Further, the sheet collection operation control section 164*b* is coupled to a driving circuit of a stepping motor MT for varying a height position of the sensor means 138 corresponding to a load amount of sheets collected on the processing tray 29.

[End Binding Operation Control Section]

The end binding operation control section 164*c* is configured to conduct the stapling means (end binding stapling unit) 31, bunch carrying-out means 100, and lifting/lowering motor MS of the stack tray 21 when the post-processing mode is set at the "end binding finish mode". Therefore, in the apparatus shown in the figure, in setting the post-processing mode, concurrently with the finish mode, a "multi-staple binding finish (hereinafter referred to as a "multi-staple mode")" or single binding finish (hereinafter referred to as a "single-staple mode")" is set in a mode setting means not shown. In the "multi-staple mode", a plurality of portions of a bunch of sheets is stapled, and in the "single-staple mode", a single portion of a bunch of sheets is stapled.

Therefore, the end binding operation control section 164*c* is configured to position the bunch carrying-out means 100 in the first standby position (state of FIG. 10*a*; front standby position) in the "multi-staple mode", while positioning the bunch carrying-out means 100 in the second standby position (state of FIG. 11*e*; back standby position) in the single staple mode. This is because of causing the bunch carrying-out means 100 (movable gripper 105*a*, fixed gripper 105*b*) to wait on the downstream side of the binding positions (post-processing positions) in the "multi-staple mode" (multiple-binding) due to the reason that the stapling unit is moved in the sheet width direction, while causing the bunch carrying-out means 100 to wait on the upstream side of the binding position in the single-staple mode that eliminates the need of moving the stapling unit. Therefore, the end binding operation control section 164*c* is coupled to a driving circuit of the driving motor MH disposed in the driving arm 126 to cause the carrier member 110 of the bunch carrying-out means 100 to reciprocate, and a driving circuit of the driving motor ME coupled to the pulley of the traveling belt 116.

Figure 11G:
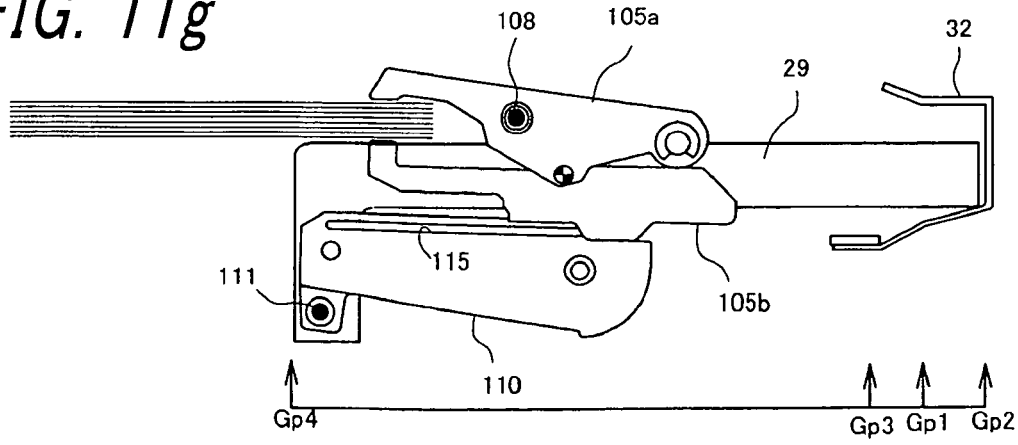
Figure 12H:
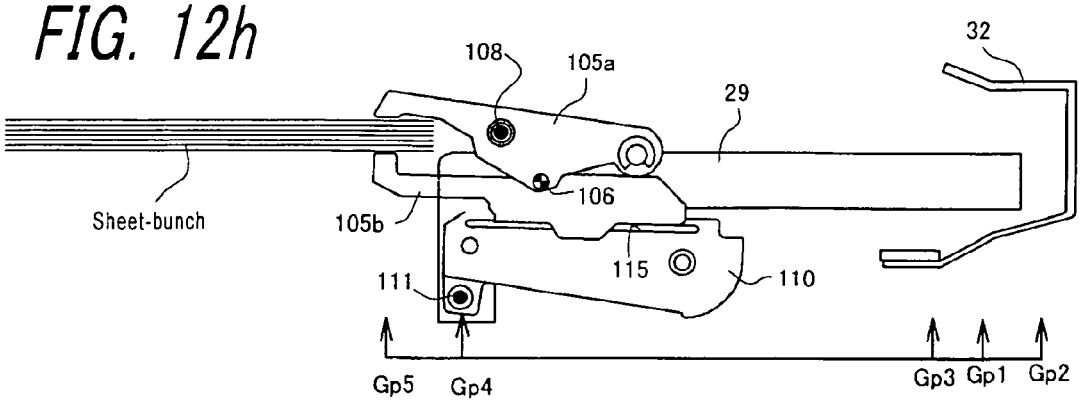
FIGS. 12*h* to 12*k* are operating state explanatory views of the sheet-bunch carrying-out means, where
Figure 12I:
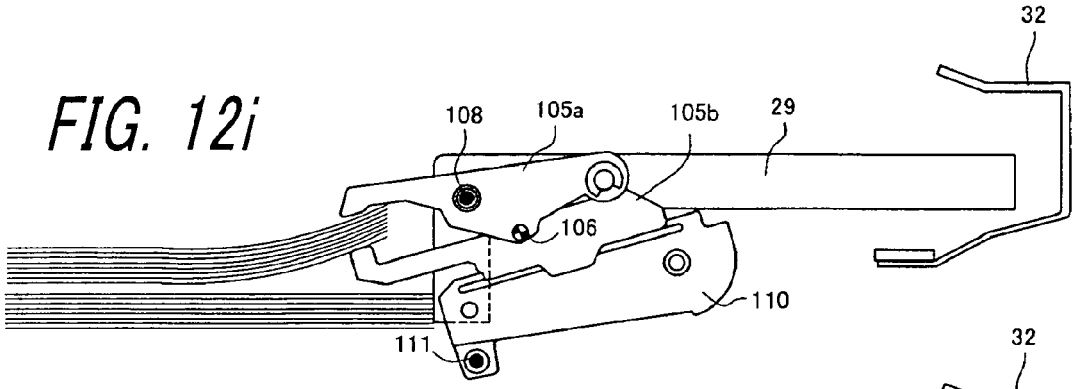
Figure 12J:
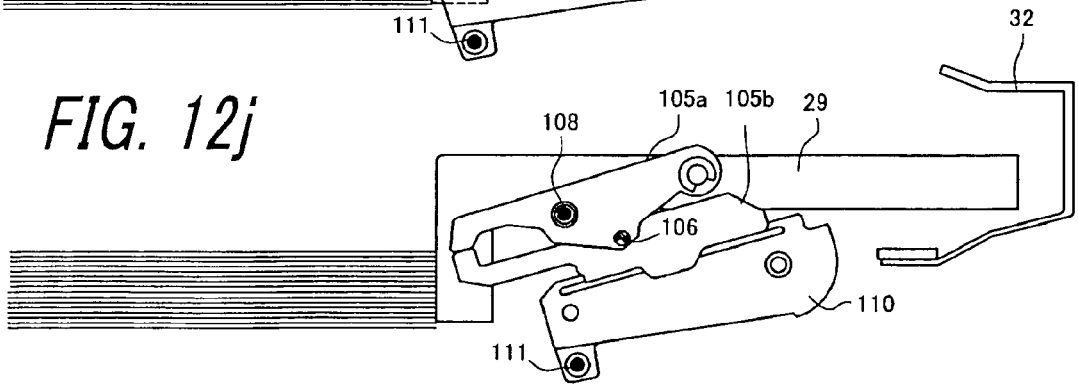
Figure 12K:
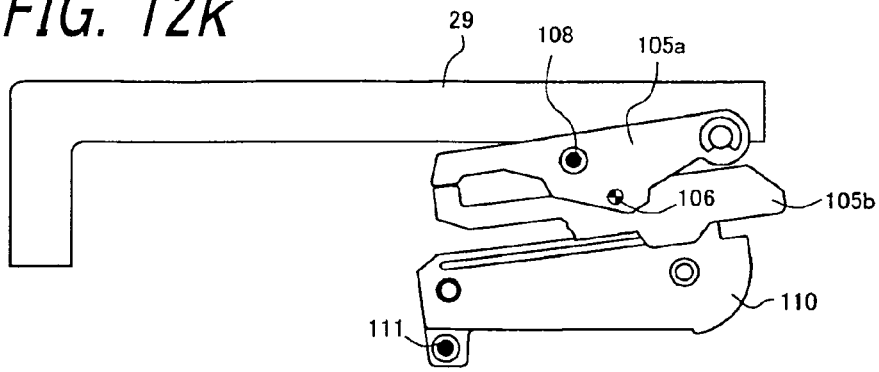

Further, the end binding operation control section 164*c* controls the driving motor MH and driving motor ME to cause the bunch carrying-out means 100 to execute the "initializing operation" in starting the image formation system or post-processing apparatus B of FIG. 1. At this point, in the initializing operation, as shown in FIGS. 10 and 11, the control section 164*c* moves the bunch carrying-out means 100 from the home position to the first standby position in FIG. 10*a*, backward position in FIG. 10*c*, and next to the second standby position in FIG. 11*e*, further moves the means 100 to the nip position in FIG. 11*f* from the second standby position, and halts the means 100 at the carrying-out position in FIG. 11*g*. This operation is executed by rotation control of the driving motor MH as described previously. Then, the section 164*c* returns the means 100 to the first standby position in FIG. 10*a* from the carrying-out position in FIG. 11*g* in the "multi-staple mode", while returning the means 100 to the second standby position in FIG. 11*e* from the carrying-out position in FIG. 11*g* in the single-staple mode, and completes the "initializing operation".

Furthermore, the binding operation control section 164*c* is coupled to driving circuits of driving motors MD incorporated into the end edge binding stapling unit 31 of the processing tray 29 and a middle binding stapling unit 40 of the collection guide 45. Then, for example, by a job finish signal from the image formation apparatus A, the section 164*c* is configured to control the driving motor MD of each of the end binding stapling means 31 and middle binding stapling unit 40 to execute the staple binding operation.

The control section configured as described above causes the post-processing apparatus B to execute the following processing operation.

[Print-out Mode]

In this mode, the image formation apparatus A forms images as a series of documents, for example, starting with the first pate, and carries out the sheet face down sequentially from the main-body sheet discharge outlet 3, and the sheet sent to the first carry-in path P1 is guided to the sheet discharge rollers 25. Then, using a signal for detecting the sheet front end in the sheet discharge outlet 25*x*, after a lapse of predicted time the sheet front end reaches the forward/backward rotation roller (switch back roller as described previously) 26*a* of the processing tray 29, the sheet feeding control section 164*a* lowers the forward/backward rotation roller 26*a* from the upper standby position onto the tray, and rotates the forward/backward rotation roller 26*a* clockwise as viewed in FIG. 2. Upon the rotation, the sheet entering onto the processing tray 29 is carried out toward the stack tray 21 by the forward/backward rotation roller 26*a*, and stored on the tray 21. Thus, subsequent sheets are sequentially carried out to the stack tray 21, and stacked and stored on the tray.

Accordingly, in this print-out mode, sheets with images formed thereon in the image formation apparatus A are held on the stack tray 21 via the first carry-in path P1 of the post-processing apparatus B, and for example, loaded and stored in the order of from the first page to nth page upward in the attitude of face-down. In this mode, sheets are not guided to the second carry-in path P2 described previously.

[Staple Binding Finish Mode]

In this mode, as in the aforementioned mode, the image formation apparatus A forms images as a series of documents in the order of from the first page to nth page, and carries out the sheet from the main-body sheet discharge outlet 3 face down, and the sheet sent to the first carry-in path P1 is guided to the sheet discharge rollers 25. Then, using a signal for detecting the sheet front end in the sheet discharge outlet 25*x*, after a lapse of predicted time the sheet front end reaches the forward/backward rotation roller 26*a* of the processing tray 29, the sheet feeding control section 164*a* lowers the forward/backward rotation roller 26*a* from the upper standby position onto the tray, and rotates the forward/backward rotation roller 26*a* clockwise as viewed in FIG. 2. Next, after a lapse of predicted time the sheet rear end is carried onto the processing tray 29, the sheet feeding control section 164*a* rotates and drives the forward/backward rotation roller 26*a* counter-clockwise as viewed in FIG. 2. Upon the rotation, the sheet entering from the sheet discharge outlet 25*x* is switch-backed and fed onto the processing tray 29 along the first carry-in path P1. By repeating this sheet feeding, a series of sheets is collected on the processing tray 29 face down in the shape of a bunch.

In addition, whenever the sheet is collected on the processing tray 29, the control CPU 161 operates side aligning plates not shown, and aligns the position in the width direction of the sheet to collect. Next, the control CPU 161 operates the end edge binding stapling unit 31 by a job finish signal from the image formation apparatus A to bind the rear end edge of a bunch of sheets collected on the processing tray. After this stapling operation, the control CPU 161 moves the bunch carrying-out means 100. Upon the moving, the bunch of sheets bound by stapling are carried out and stored on the stack tray 21. By this means, a series of sheets with images formed in the image formation apparatus A is bound by stapling and stored on the stack tray 21.

What is claimed is:

1. A sheet processing apparatus comprising:

a sheet discharge path that sequentially carries out a sheet;

a processing tray that collects sheets from the sheet discharge path in a shape of a bunch;

a stacker that is disposed on a downstream side of the processing tray and that holds the sheets from the processing tray; and a bunch carrying-out device disposed in the processing tray to carry out a bunch of sheets toward the stacker, wherein the bunch carrying-out device comprises:

a carrier member disposed movably in a sheet-bunch carrying-out direction relative to the processing tray, a carrier driving device attached to the carrier member for moving the carrier member in the sheet-bunch carrying out direction relative to the processing tray, and a sheet engagement member disposed on the carrier member, the sheet engagement member engaging the bunch of sheets on the processing tray, and being mounted on the carrier member to move in the sheet-bunch carrying-out direction relative to the carrier member, wherein the carrier driving device moves the carrier member to position in the sheet-bunch carrying-out direction along the processing tray, and the sheet engagement member has an engagement member driving device for moving the sheet engagement member to position in the sheet-bunch carrying-out direction along the carrier member, and wherein the carrier driving device is controlled to move the engagement member above the processing tray when the bunch carrying out device carries out the bunch of sheets toward the stacker and to move the engagement member under the processing tray when returning from the position in the sheet bunch carrying-out direction.

2. The sheet processing apparatus according to claim 1, wherein the control device has a first operation control mode for causing the carrier member to reciprocate between the base end and the front end of the processing tray with the sheet engagement member being in the base-end storing position, a second operation control mode for moving the sheet engagement member to the front-end carrying-out position protruding in the sheet-bunch carrying-out direction from the base-end storing position with the carrier member resting in a predetermined position of the processing tray, and a third operation control mode for moving the carrier member to the front end from the base end of the processing tray, and further, moving the sheet engagement member to the front-end carrying-out position protruding in the sheet-bunch carrying-out direction.

3. The sheet processing apparatus according to claim 2, wherein the control device executes an initial operation in the first operation control mode and/or the second operation control mode in starting the apparatus.

4. The sheet processing apparatus according to claim 3, wherein the sheet engagement member is comprised of a gripper member for grasping the bunch of sheets collected on the processing tray, and the gripper member has a grip releasing device.

5. The sheet processing apparatus according to claim 1, wherein the carrier member driving device and the engagement member driving device are configured to enable the carrier member and the sheet engagement member to move in mutually opposite directions in carrying out the bunch of sheets on the processing tray, and move the carrier member in the direction opposite to a movement direction of the sheet engagement member when the sheet engagement member engages with the bunch of sheets on the processing tray and/or releases the sheets to the stack tray.

6. An image formation system comprising:

an image formation apparatus that sequentially forms an image on a sheet; and a sheet processing apparatus that performs post-processing on the sheet from the image formation apparatus, wherein the sheet processing apparatus has a configuration according to claim 1.

7. A sheet processing apparatus comprising:

a sheet discharge path that sequentially carries out a sheet;

a processing tray that collects sheets from the sheet discharge path in the shape of a bunch;

a stacker that is disposed on the downstream side of the processing tray and that holds the sheets from the processing tray; and bunch carrying-out means disposed in the processing tray to carry out a bunch of sheets toward the stacker;

wherein the bunch carrying-out means is comprised of a carrier member disposed movably in a sheet-bunch carrying-out direction of the processing tray, and a sheet engagement member that engages with the bunch of sheets on the processing tray, and the sheet engagement member is mounted on the carrier member to be able to move to positions in the sheet-bunch carrying-out direction, and wherein the carrier member has carrier driving means for moving the carrier member to positions in the sheet-bunch carrying-out direction along the processing tray, the sheet engagement member has engagement member driving means for moving the sheet engagement member to position in the sheet-bunch carrying-out direction along the carrier member, and control means controlling the carrier driving means and the engagement member driving means controls the carrier driving means to move the carrier member to a front end from a base end of the processing tray, while controlling the engagement member driving means to travel between a base-end storing position overlapping with the carrier member and a front-end carrying-out position protruding from the carrier member in the sheet-bunch carrying-out direction.

8. The sheet processing apparatus according to claim 1, wherein a velocity of the sheet engagement member is adjusted to be equal to a velocity of the carrier member so that the relative velocity is zero.

9. The sheet processing apparatus according to claim 8, wherein the velocity of the sheet engagement member is directionally opposite to the velocity of the carrier member.

10. A sheet processing apparatus, comprising:

a sheet discharge path that sequentially carries out a sheet;

a processing tray that collects sheets from the sheet discharge path in a shape of a bunch;

a stacker that is disposed on a downstream side of the processing tray and that holds the sheets from the processing tray; and a bunch carrying-out device disposed in the processing tray to carry out a bunch of sheets toward the stacker, wherein the bunch carrying-out device comprises:

a carrier member disposed movably in a sheet-bunch carrying-out direction relative to the processing tray, a carrier driving device attached to the carrier member for moving the carrier member in the sheet-bunch carrying out direction relative to the processing tray, and a sheet engagement member disposed on the carrier member, the sheet engagement member engaging the bunch of sheets on the processing tray, and being mounted on the carrier member to move in the sheet-bunch carrying-out direction relative to the carrier member, wherein the carrier driving device moves the carrier member to position in the sheet-bunch carrying-out direction along the processing tray, and the sheet engagement member has an engagement member driving device for moving the sheet engagement member to position in the sheet-bunch carrying-out direction along the carrier member, and wherein a control device controlling the carrier driving device and the engagement member driving device controls the carrier driving device to move the carrier member to a front end from a base end of the processing tray, while controlling the engagement member driving device to travel between a standby position and a front-end carrying-out position.

* * * * *